US006493516B2

(12) United States Patent
Murakami et al.

(10) Patent No.: US 6,493,516 B2
(45) Date of Patent: Dec. 10, 2002

(54) TONER CONTAINER AND METHOD OF DETERMINING ABNORMALITY OF TONER CONTAINER

(75) Inventors: Katsuya Murakami, Shizuoka (JP); Yutaka Ban, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/900,944

(22) Filed: Jul. 10, 2001

(65) Prior Publication Data

US 2002/0025183 A1 Feb. 28, 2002

(30) Foreign Application Priority Data

Jul. 12, 2000 (JP) ..... 2000-211299
Oct. 25, 2000 (JP) ..... 2000-325367

(51) Int. Cl.[7] ..... G03G 15/00

(52) U.S. Cl. ..... 399/9; 399/88; 399/120; 399/256

(58) Field of Search ..... 399/9, 24, 25, 399/27, 36, 37, 88, 109, 110, 120, 256, 260

(56) References Cited

U.S. PATENT DOCUMENTS

| | | | | |
|---|---|---|---|---|
| 5,374,977 A | * | 12/1994 | Shiina et al. | 399/27 |
| 5,579,101 A | | 11/1996 | Omata et al. | 399/114 |
| 5,870,652 A | | 2/1999 | Kanamori et al. | 399/106 |
| 6,131,008 A | | 10/2000 | Kanamori et al. | 399/263 |
| 6,278,853 B1 | * | 8/2001 | Ban et al. | 399/109 |
| 6,289,193 B1 | | 9/2001 | Ban et al. | 399/258 |
| 6,363,233 B1 | * | 3/2002 | Nakajima | 399/120 |

* cited by examiner

*Primary Examiner*—Sophia S. Chen
(74) *Attorney, Agent, or Firm*—Fitzpatrick, Cella, Harper & Scinto

(57) ABSTRACT

A toner container is detachably mountable on an image forming apparatus and includes a container body that contains toner therein. An agitating member is disposed within the container body and agitates the toner within the container body. First and second rotating portions rotate together with a rotary shaft of the agitating member at both end sides of the rotary shaft. The first and second rotating portions are exposed to the exterior of the container body, wherein the container body includes a first mark at a position corresponding to a predetermined position of the first rotating portion and a second mark at a position corresponding to a predetermined position of the second rotating portion.

36 Claims, 26 Drawing Sheets

301h
301a
303e
303
306
301i
301E
301l
301e 301
301A
301m
306
301h
303
303e
301a
301f
301D
301j
301E
301c
301e
301b2
301k
301b1

301m
301f
301c
301E
305
301H
301j
301F
301G 301j
301k
301c
303
301m
303e 309
306
303
301a1
301a
305a
302
305b
305
301D
305c
301c
301E
309
301e
308
309
310
301b2
311
301i
301b1

301j
301m
301l
301c
308
301j
301l 301E
301g
301h
301j
301e 301A
301A1
301h
301m
301k
301a
301g
301K
301j
301E
301J
301e
301B
301f 301E
301k
301c
301j
301m
301a

301A1
301n
301h
301a
301g
301D
301E
301c
301B
301b2
301i
301b1

301j
301m
301n
301E
301j
301F
301G
301H 301j
301m
301c
301E
301l
301j
301l

TONER CONTAINER AND METHOD OF DETERMINING ABNORMALITY OF TONER CONTAINER

BACKGROUND OF THE INVENTION

1. Field of the Invention

The present invention relates to a toner container that is detachably mountable onto an image forming apparatus such as a copying machine, a printer or a facsimile machine, and a method of determining the abnormalities of the toner container.

2. Description of the Related Art

Up to now, fine powder toner has been used as a developer in an image forming apparatus such as an electrostatic copying machine or a printer. In the case where the toner in the image forming apparatus main body has been completely consumed, the toner is supplied to the image forming apparatus main body with the use of a toner supplying container detachably mountable on the image forming apparatus main body.

When toner is supplied to a main body of the image forming apparatus, an agitating and feeding member within a toner supplying container is rotated by a driving force from the image forming apparatus main body to feed the toner, and the toner is discharged from an opening portion bit-by-bit and then supplied to the image forming apparatus main body.

The toner supplying container main body, the agitating and feeding member disposed within the toner supply container main body, and parts such as a gear which transmits a driving force to the toner supplying container main body an the agitating and feeding member have long lifetimes and are useable even if the toner within the container has been completely consumed. In recent years, the container from which the toner has been supplied and completely consumed is increasingly collected and recycled.

However, the conventional toner container suffers from the following drawbacks.

In the case where the toner supplying container is stored for a long period of time or vibrated during transportation, whereby air around the toner within the container escapes and the toner has a high density, the rotation torque of the agitating and feeding member goes up. In the worst case, the member may be deformed and damaged.

When recycling the above-described container, there is a fear that force exerted on the toner due to a sliding friction between the agitating member and the inner wall of the container will result in the toner being fused and bonded together into coarse-grained particles (coarse particles). Also, in the case of a toner supplying container that uses a flexible elastic member for the agitating and feeding member that feeds and discharges the toner, the sliding frictional force between the elastic member and the inner wall of the container is weakened and the remaining amount of toner increases.

Also, because the toner supplying container is tightly closed due to heat or ultrasonic welding after the parts have been assembled in the interior of the container and because it is difficult to separate the parts of the toner supplying container, particularly in the small toner supplying opening or the toner filling inlet of the toner supplying container, there arises a problem where it is very difficult to recognize the abnormalities of the interior of the container from which the toner has been supplied. This is a large factor that prevents the recycling of the container. For that reason, up to now, the container has been destroyed, the parts have been extracted from the container, and the dimensions, the configurations and the like have been recognized. Even then only the parts have been recycled. Thus, the recycling is not efficient.

SUMMARY OF THE INVENTION

The present invention has been made under the above-described circumstances, and therefore an object of the present invention is to provide a toner container which is capable of readily determining abnormalities of the agitating member, such as deformation.

Another object of the present invention is to provide a determining method which is capable of readily determining an abnormality of the agitating member, such as deformation.

Another object of the present invention is to provide a determining method which is capable of readily determining the abnormality of the agitating member such as deformation.

Still another object of the present invention will become apparent by reading the following detailed description with reference to the accompanying drawings.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Now, a description will be given in more detail of preferred embodiments of the present invention with reference to the accompanying drawings.

First Embodiment

First, a description will be given of the structure of an electrophotographic copying machine which is an example of an image forming apparatus using an electrophotographic process onto which a toner supplying container (toner container) according to the present invention is mounted with reference to FIG. 1.

Figure 1:
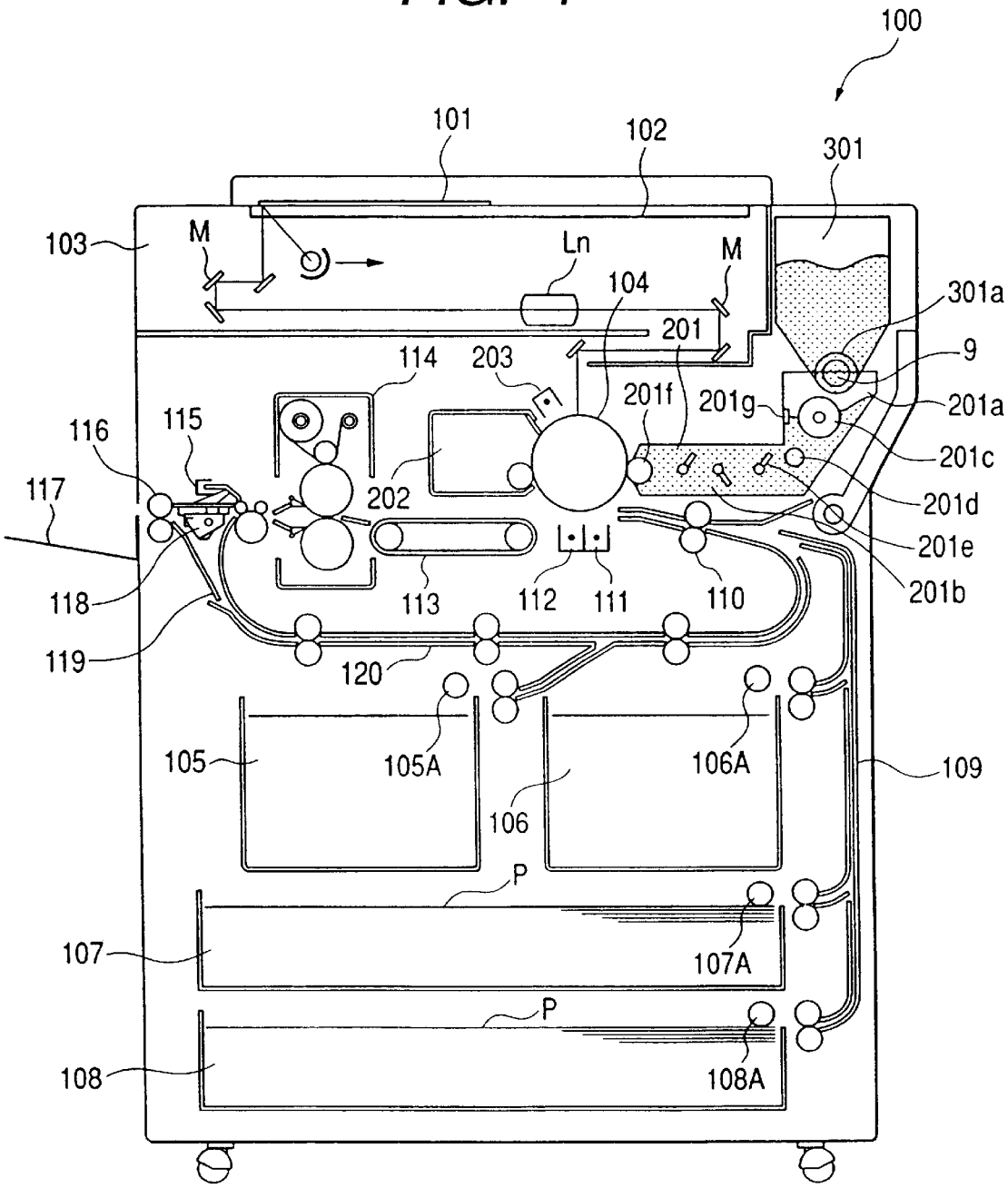
FIG. 1 is a vertical cross-sectional view showing the structure of an electrophotographic copying machine which is one example of an electrophotographic image forming apparatus onto which a toner supplying container according to the present invention is mounted.

Referring to FIG. 1, reference numeral 100 denotes an electrophotographic copying machine main body (hereinafter referred to as apparatus main body). Also, reference numeral 101 denotes an original that is placed on an original glass stand 102. Then, an optical image corresponding to image information is imaged on an electrophotographic photosensitive drum 104 that serves as an image bearing member through a plurality of mirrors M and a lens Ln in an optical portion 103. Reference numerals 105 to 108 out of recording medium (hereinafter referred to as sheet) P loaded in those cassettes 105 to 108 on the basis of information inputted from an operating portion 100*a* in FIG. 2 by a user or a paper size of the original 101 In this example, the recording medium P is not limited to a sheet of paper, but for example, an OHP sheet or the like can be appropriately selected. Reference character 100*b* denotes an indicating means that indicates an operated command, a state of the image forming apparatus or the like.

Then, a single sheet P conveyed from sheet feed and separating devices 105A to 108A is conveyed to a registration roller 110 through a transporting portion 109, and further conveyed while the rotation of the photosensitive drum 104 and the timing of scanning of the optical portion 103 are synchronized with each other. Reference numeral 111 and 112 denote a transfer discharger and a separation discharger. In this example, a toner image formed on the photosensitive drum 104 is transferred onto the sheet P by the transfer discharger 111. Then, the sheet P onto which the toner image has been transferred is separated from the photosensitive drum 104 by the separation discharger 112.

Thereafter, after a toner image has been fixed on the sheet P transported by a transporting portion 113 due to heat and pressure in the fixing portion 114, in case of one-side copying, the sheet P passes through a delivery turn-over portion 115 and is then delivered to a delivery tray 117 through a delivery roller 116. Also, in the case of two-side copying, after the sheet P has been transported to the registration roller 110 through refeeding transport paths 119 and 120, the sheet P is delivered to the delivery tray 117 through the same path as that in the case of the one-side copying.

Also, in the case of multi-copying, the sheets P pass through the delivery turn-over portion 115 and a part of the sheets P is delivered out of the apparatus by the delivery roller 116 once. Thereafter, a trailing edge of the sheet P passes through a flapper 118 and is then transported to the interior of the apparatus again by controlling the flapper 118 at a timing when the sheet P is nipped by the delivery roller 116 and while the delivery roller 116 is reversed. Furthermore, after the sheet P has been transported to the registration roller 110 through refeeding transport paths 119 and 120, the sheet P is delivered to the delivery tray 117 through the same path as that in the case of one-side copying.

Note that, in the apparatus main body 100 thus structured, a developing portion 201 that serves as a developing means, a cleaning device 202, a primary charger 203 and the like are disposed in the periphery of the photosensitive drum 104. In this example, the developing portion 201 is so designed as to develop an electrostatic latent image formed on the photosensitive drum 104 by the optical portion 103 on the basis of the information on the original 101 by using toner. Then, a toner supplying container 301 that serves as a toner container for supplying the toner to the developing portion 201 is detachably mounted on the apparatus main body 100 by the user.

In this example, the developing portion 201 has a toner hopper 201*a* and a developing device 201*b*. The toner hopper 201*a* includes an agitating member 201*c* with a screw blade 201*g* for agitating the toner supplied from a toner supply opening portion 301*a* of the toner supplying container 301 through a toner receiving port 9. Then, the toner agitated by the agitating member 201*c* is fed to the developing device 201*b* by a magnet roller 201*d*. The developing device 201*b* has a developing roller 201*f*; and a carrying member 201*e*. Then, the toner fed from the toner hopper 201*a* by the magnet roller 201*d* is fed to the developing roller 201*f* by the feeding member 201*e* and then supplied to the photosensitive drum 104 by the developing roller 201*f*.

The cleaning device 202 is so designed as to remove the toner remaining in the photosensitive drum 104. Also, the primary charger 203 is so designed as to charge the photosensitive drum 104.

Figure 2:
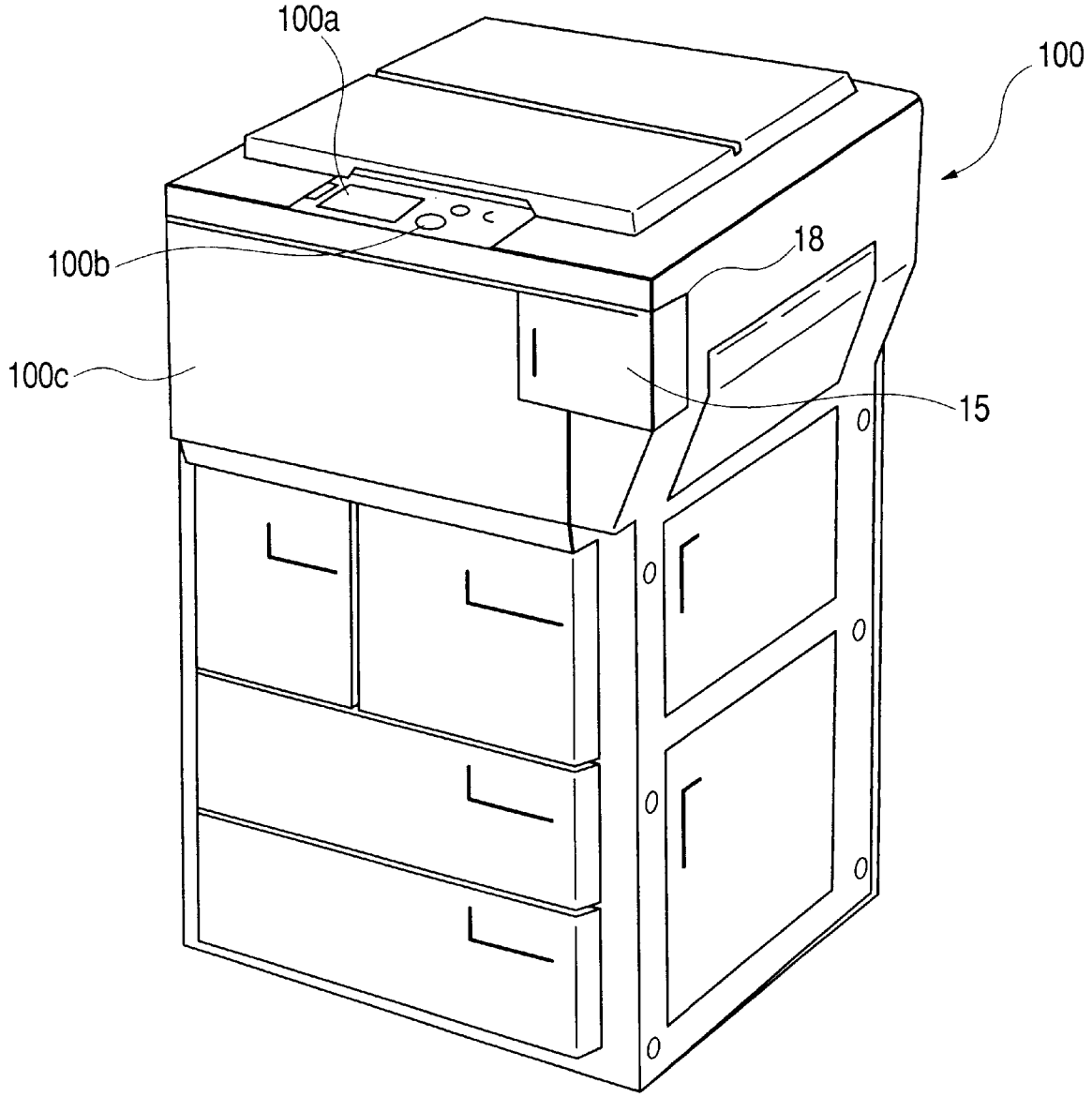
FIG. 2 is a perspective view showing the electrophotographic copying machine.
Figure 3:
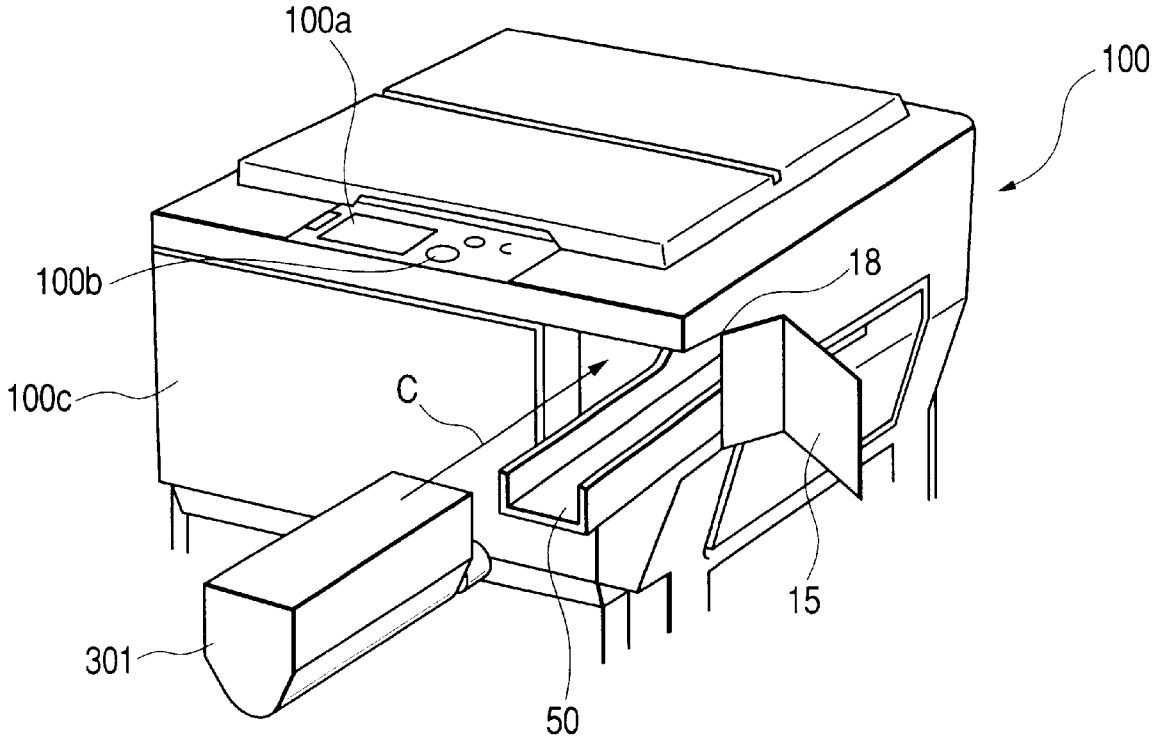
FIG. 3 is a perspective view showing an appearance in which the toner supplying container is mounted on the electrophotographic copying machine after a cover for exchanging a toner supplying container of the electrophotographic copying machine is opened.

When a toner supplying container exchange cover 15 (hereinafter referred to as "exchange cover") which is a part of an outer packaging cover that is pivotally supported to the apparatus main body 100 by a hinge 18 shown in FIG. 2 is opened by the user as shown in FIG. 3, a container receiving table 50 is drawn to a predetermined position by a driving system (not shown). Then, the toner supplying container 301 is inserted on the container receiving table 50 in a direction indicated by an arrow C and mounted. When the user takes out the toner supplying container 301 from the apparatus main body 100, the toner supplying container 301 put on the drawn container receiving table 50 is extracted. In this example, the exchange cover 15 is opened and closed only for detaching and attaching the toner supplying container 301. Note that the maintenance of the apparatus main body 100 is conducted by opening/closing the front cover 100*c*.

Also, it is possible that the toner supplying container 301 is mounted on the apparatus main body 100 not through the container receiving table 50 but directly, and also taken out from the apparatus main body 100.

Also, in this embodiment, all of the toner is not supplied to the image forming apparatus main body side in a state where the toner supplying container is mounted on the image forming apparatus main body, but instead the toner is appropriately supplied in accordance with the consumption of the toner in the developing portion.

(The Entire Structure of Toner Supplying Container)

Subsequently, the toner supplying container according to this embodiment will be described. In this embodiment, the toner feeding member and the toner agitating member are disposed in the interior of the toner supplying container.

Figure 4A:
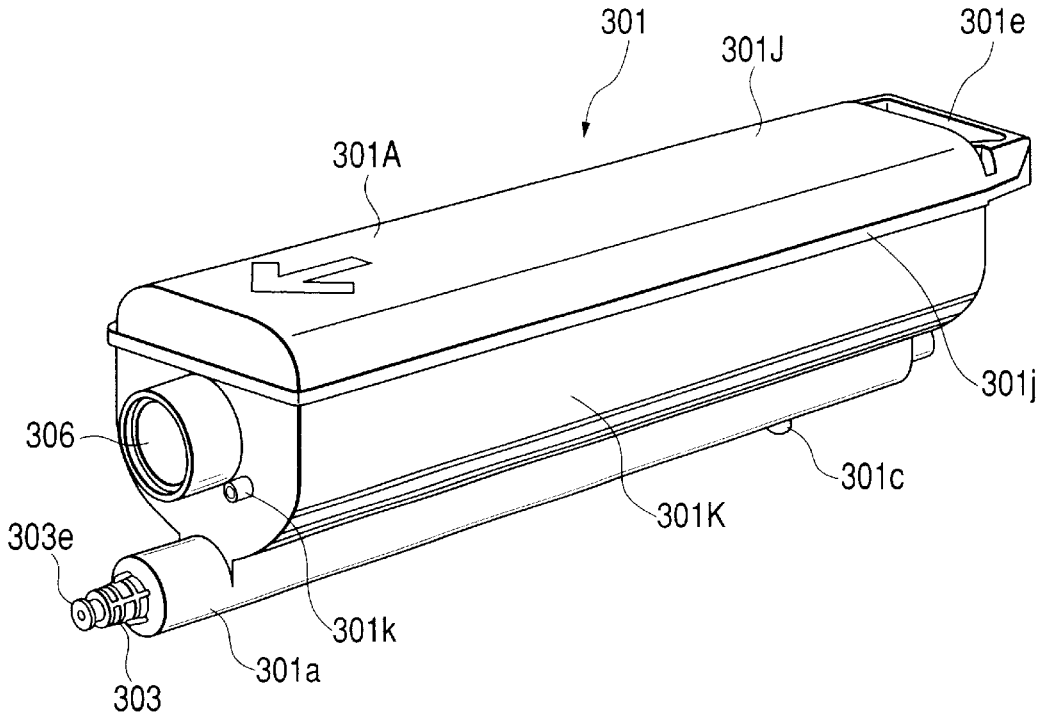
FIG. 4A is a perspective view showing the toner supplying container in accordance with an embodiment of the present invention viewed from a side where a sealing member is disposed.
Figure 4B:
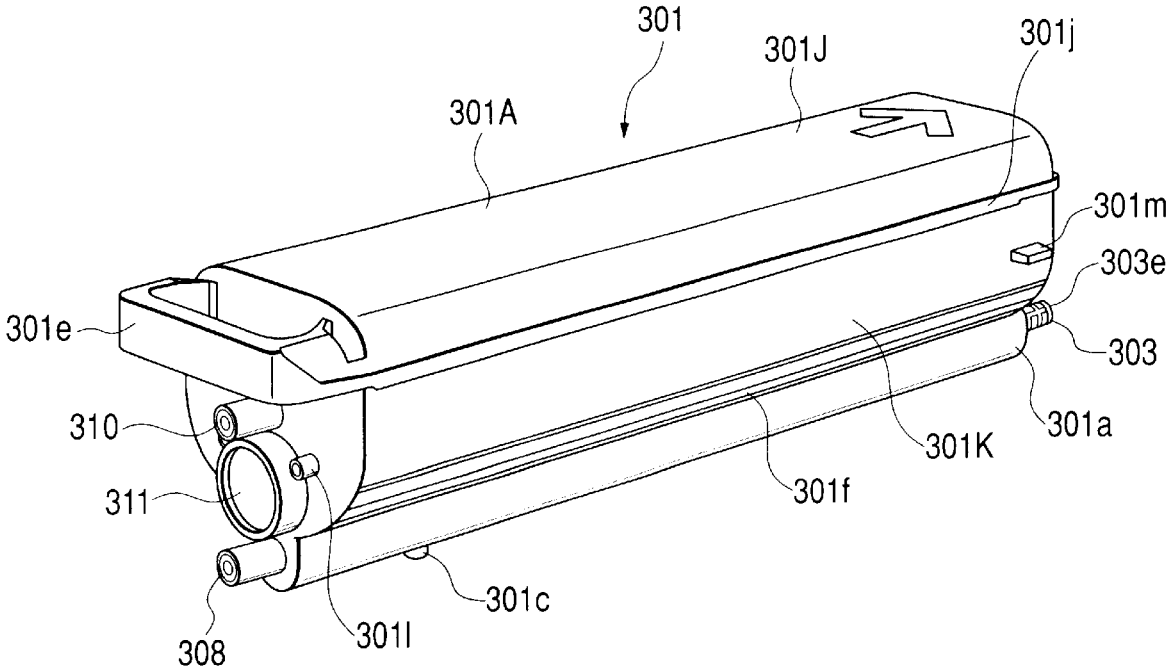
FIG. 4B is a perspective view showing a toner supplying container viewed from a side where a grip is disposed.

FIGS. 4A and 4B are perspective views showing the toner supplying container 301 in accordance with this embodiment.

Figures 5A, 5B, 5C, 5D, 5E, 5F:
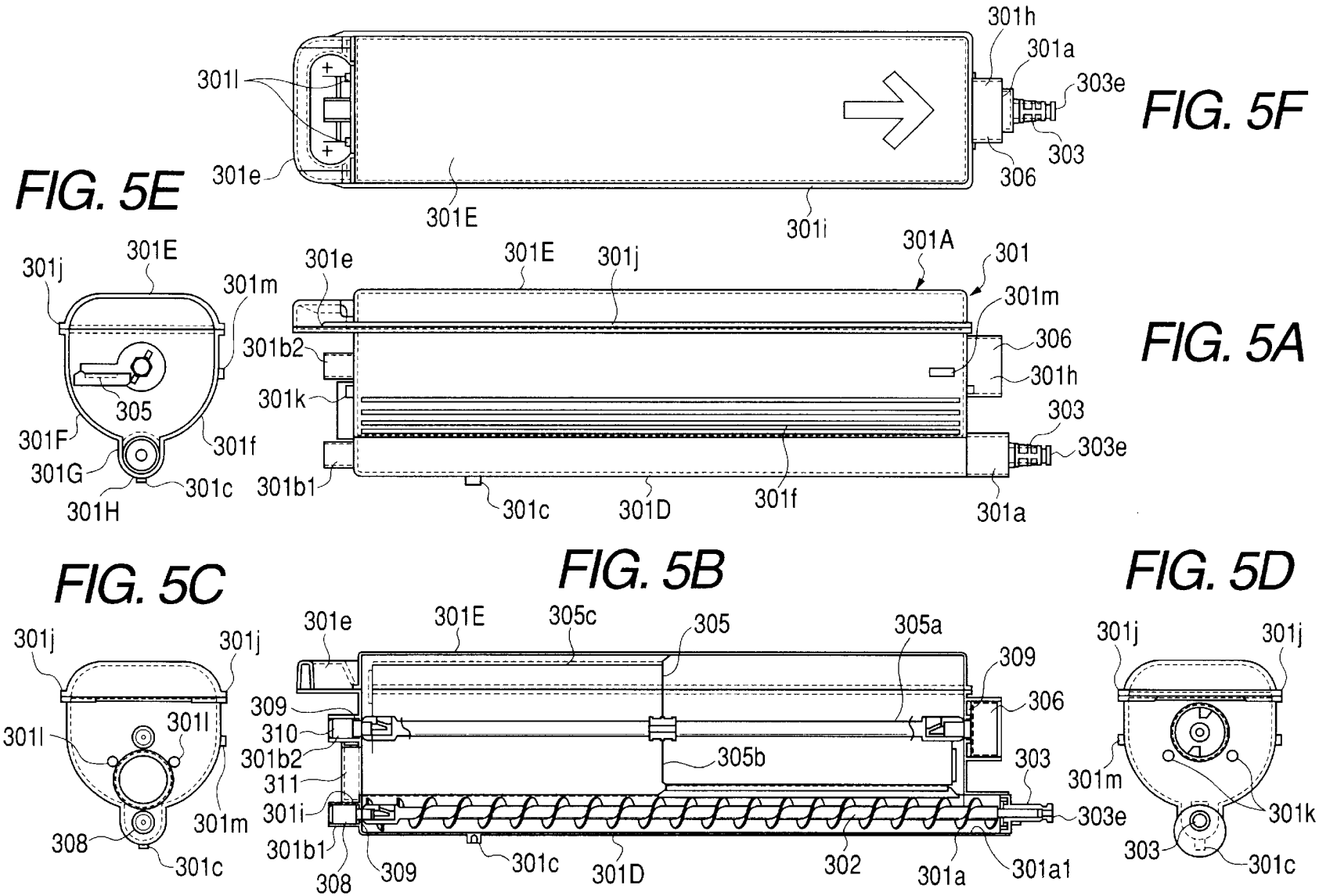
FIG. 5A is a front view showing the toner supplying container in accordance with the embodiment of the present invention.
FIG. 5B is a vertical cross-sectional view thereof.
FIG. 5C is a left side view thereof.
FIG. 5D is a right side view thereof.
FIG. 5E is a side cross-sectional view thereof.
FIG. 5F is a plan view thereof.
Figure 6:
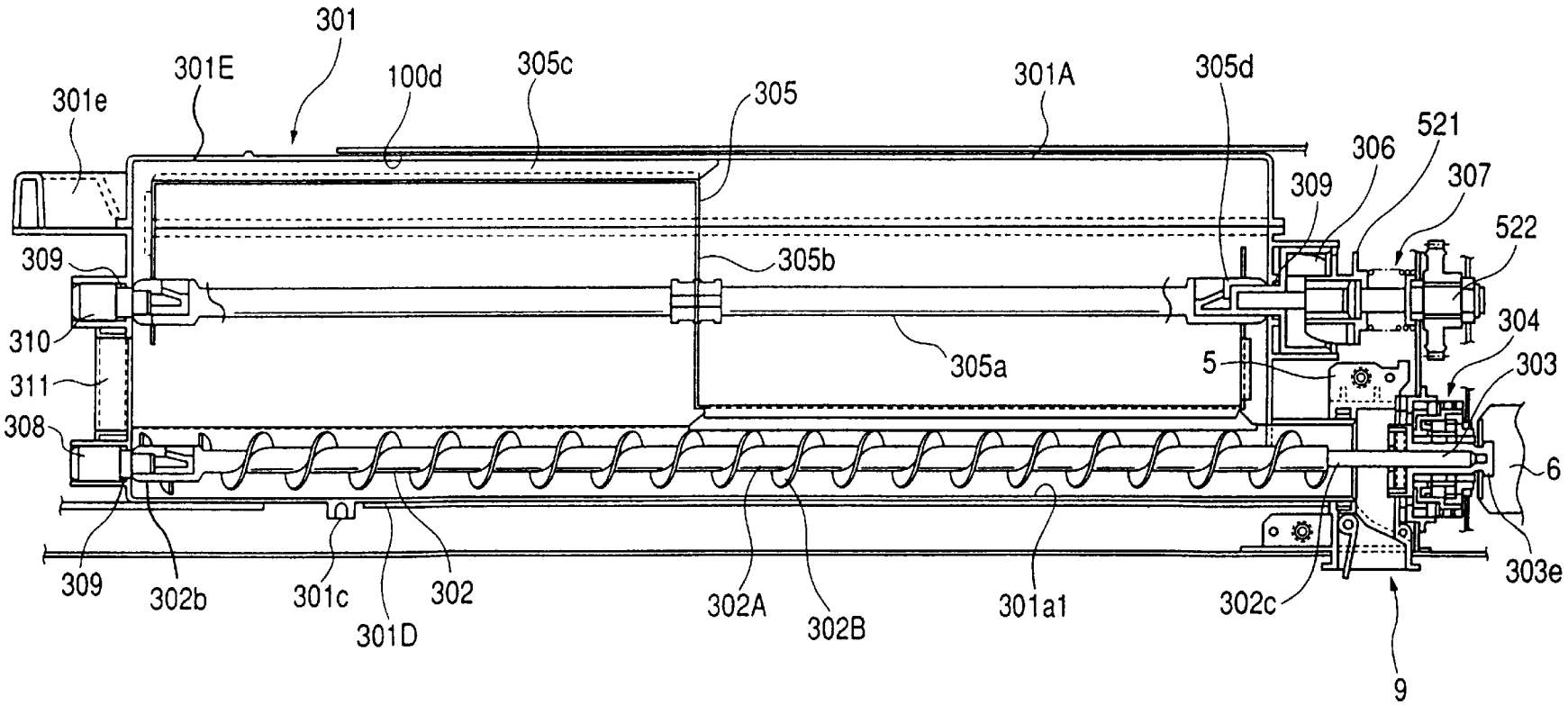
FIG. 6 is a front cross-sectional view showing a state in which the toner supplying container is mounted in the apparatus main body, and the supply opening portion is unsealed.
Figure 7:
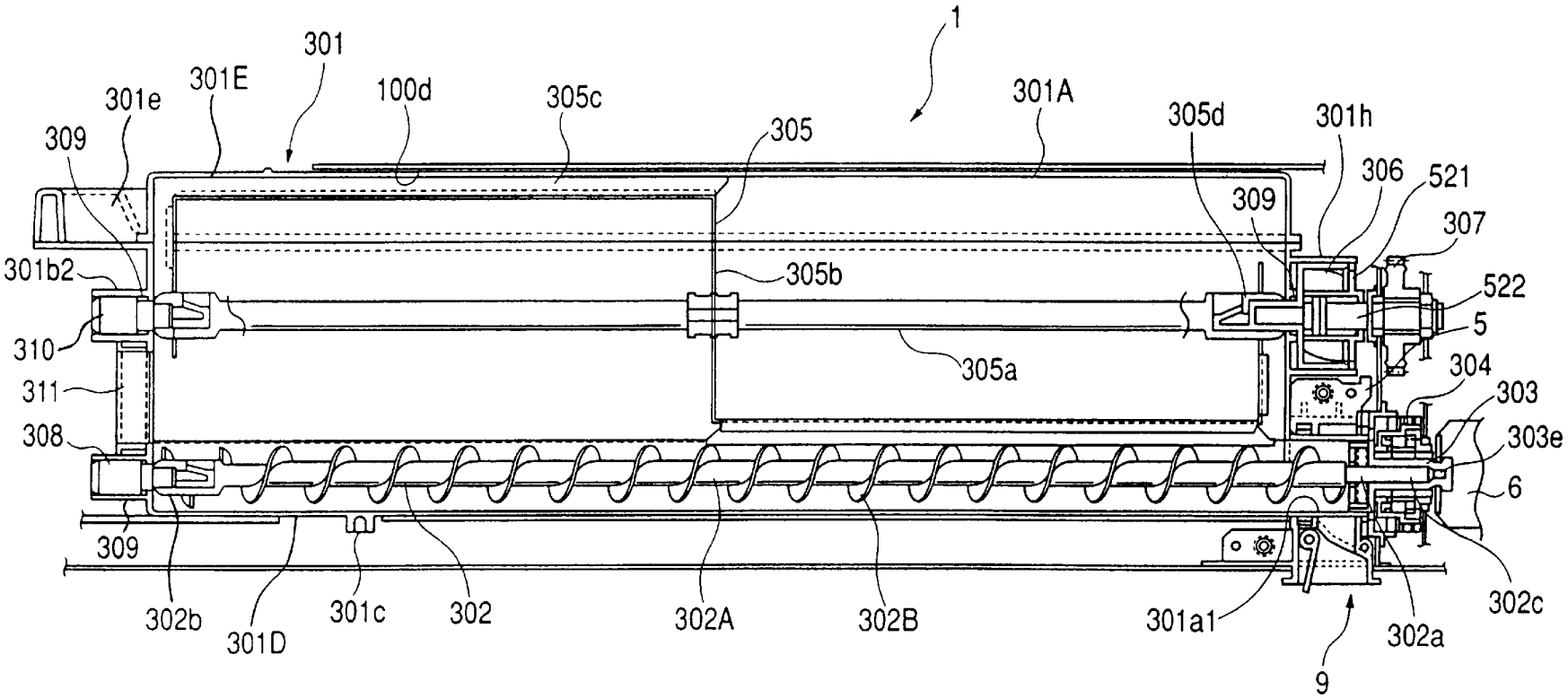
FIG. 7 is a front cross-sectional view showing a state in which the toner supplying container is mounted in the apparatus main body, and the supply opening portion is sealed.

FIG. 5A is a front view showing the toner supplying container in accordance with this embodiment, FIG. 5B is a cross-sectional view of the toner supplying container, FIG. 5C is a left side view of the toner supplying container, FIG. 5D is a right side view of the toner supplying container, FIG. 5E is a side cross-sectional view of the toner supplying container, and FIG. SF is a plan view of the toner supplying container. FIG. 6 is a front cross-sectional view showing a state in which the toner supplying container is mounted in the apparatus main body 100, and the supply opening portion is unsealed. FIG. 7 is a front cross-sectional view showing a state in which the toner supplying container is mounted in the apparatus main body 100, and the supply opening portion is sealed.

Referring to FIGS. 4A to 7, reference character 301A denotes a container main body that serves as a containing portion, 302 is a feeding member for feeding the toner received in the container main body 301 A in a direction of the toner supply opening portion 301*a*. The feeding member 302 is formed of a screw having a screw blade. Reference numeral 303 denotes a sealing member for sealing the toner supplying port 301*g*shown in FIG. 8A, and reference numeral 304 shown in FIG. 6 is a coupling member for transmitting a drive force to the sealing member 303 when the toner supplying container 301 is mounted in the apparatus main body 100. Reference numeral 305 denotes a rotary type agitating member (hereinafter referred to as "agitating member") for agitating the toner within the container main body 301A. A rotating portion 306 is engaged with a rotary shaft of the agitating member 305 so as to rotate together with the rotary shaft and has a transmitting portion that transmits the rotary drive force from the image forming apparatus to the rotary shaft of the agitating member 305. Reference numeral 307 denotes a second coupling member that transmits the rotary drive force to the transmitting portion 306 when the toner supplying container 301 is mounted in the apparatus main body 100. Also, the transmitting portion 306 has an engaging portion that is engaged with the second coupling member.

Also, reference numeral 309 denotes an oil seal that serves as a packing member for preventing the leakage of the toner.

Figure 8A:
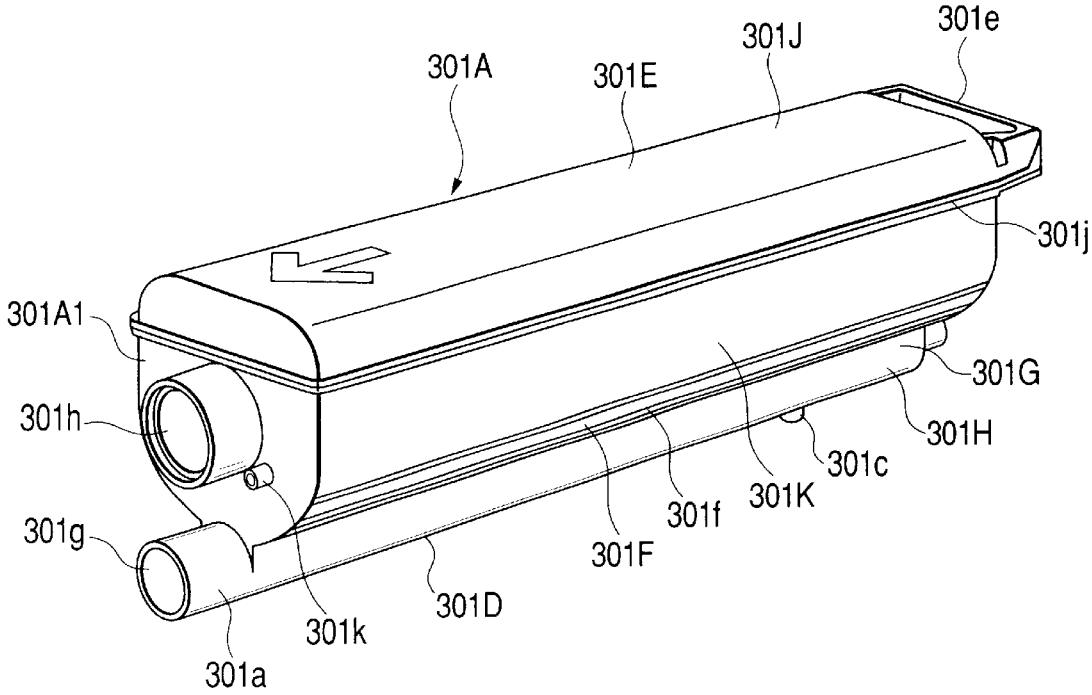
FIG. 8A is a perspective view showing the toner container parts in accordance with the embodiment of the present invention viewed at a side where a supply opening portion is disposed.
Figure 8B:
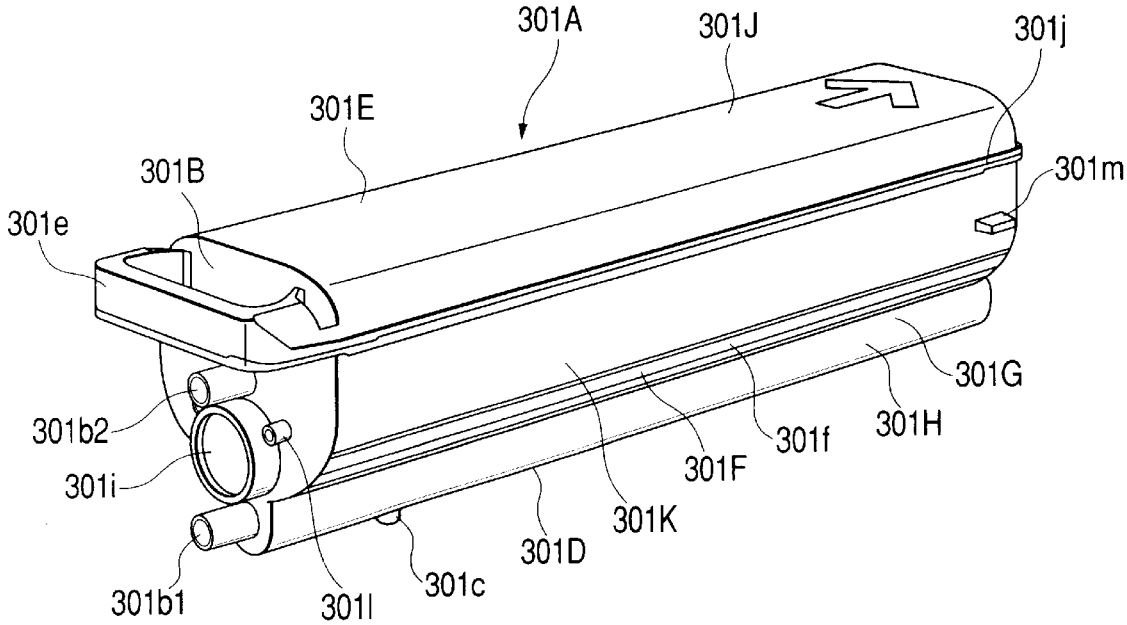
FIG. 8B is a perspective view showing the toner container parts viewed from a side where the grip is disposed.

In this example, the toner supplying container part, which is the toner supplying container main body 301A, will be described with reference to FIGS. 8A, 8B and 9A to 9F. FIGS. 8A and 8B are perspective views showing the container main body.

Figures 9A, 9B, 9C, 9D, 9E, 9F:
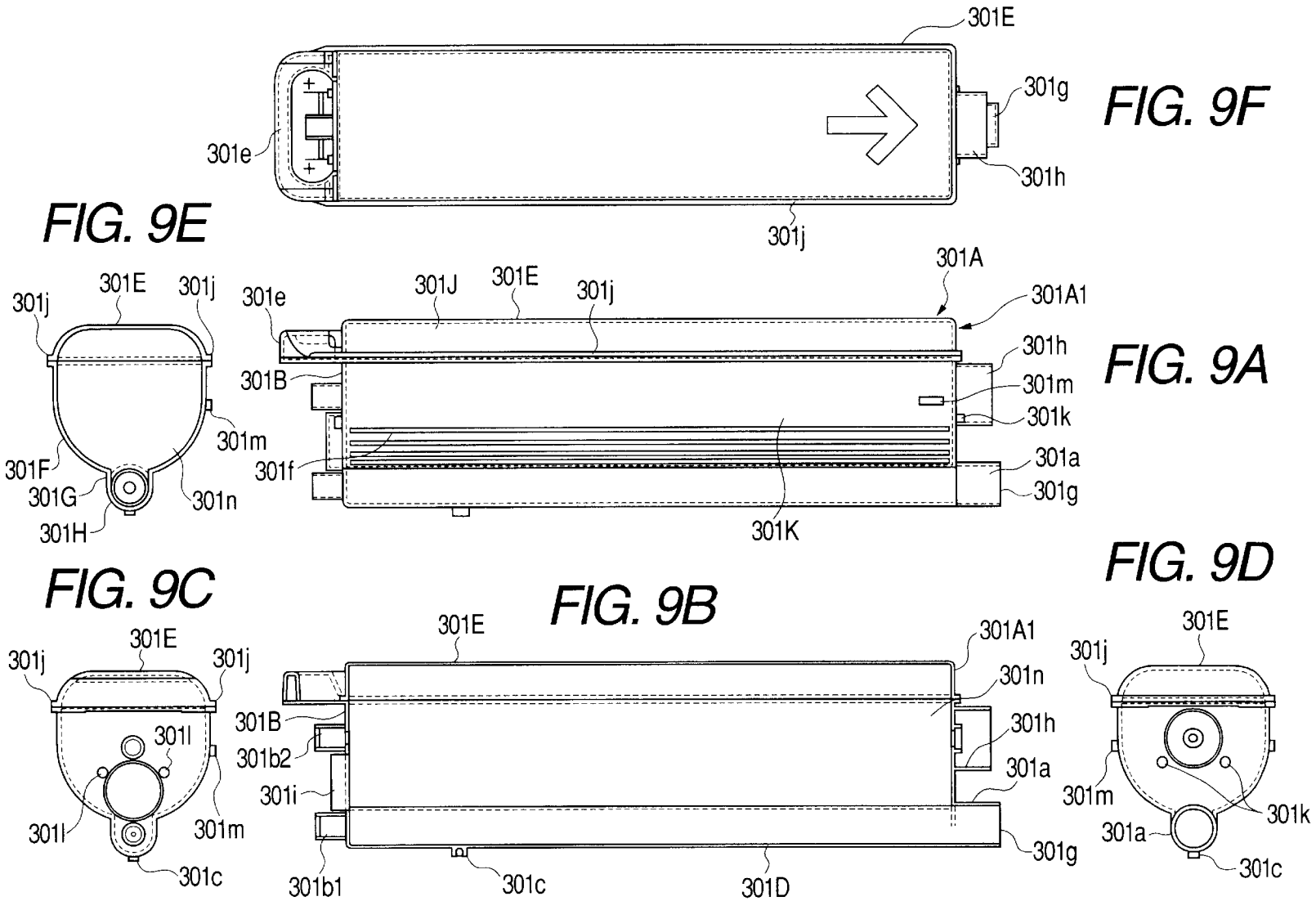
FIG. 9A is a front view showing the toner container parts.
FIG. 9B is a vertical cross-sectional view thereof.
FIG. 9C is a left side view thereof.
FIG. 9D is a right side view thereof.
FIG. 9E is a side cross-sectional view thereof.
FIG. 9F is a plan view thereof.

Also, FIG. 9A is a front view showing the toner container parts, FIG. 9B is a cross-sectional view thereof, FIG. 9C is a left side view thereof, FIG. 9D is a right side view thereof, FIG. 9E is a side cross-sectional view thereof, and FIG. 9F is a plan view thereof.

The toner supplying container main body 301A includes a curved portion 301F having a width which is narrower toward the lower portion, a linear portion 301G having a substantially constant width disposed on the lower portion of the curved portion, and a semi-circular portion 301H which is substantially semi-circular and disposed on the lower portion of the linear portion 301G.

It is preferable that the container main body 301A is manufactured using resin such as plastic through an integral molding method such as an injection molding, a blow molding or an injection blow molding. However, other materials or manufacturing methods may be applied. In other words, the container main body 301A may be manufactured through a method in which the container main body 301A is divided into two pieces or more for convenience, and those pieces are integrated together by a welding, bonding or other means.

A cylindrical toner supplying opening portion 301*a* for supplying the toner contained in the toner containing portion 301*n* to the apparatus main body is projected from a lower portion of one side surface 301A1 which is a wall surface of the container main body 301A which crosses the rotary axis of the agitating member 305. Also, the toner supplying port 301*g* is disposed on one end portion of the toner supply opening portion 301*a*.

Also, a first receiving portion 301*b*1 for rotatably holding the feeding member 302 is formed at a position of the other side surface 301B corresponding to the toner supply opening portion 301*a*. In addition, a positioning portion 301*c* positioned by the apparatus main body 100 when the toner supplying container 301 is mounted in the apparatus main body 100 is disposed on the outer side of the lower surface 301D. The positioning portion 301*c* also functions as an engaging portion 301*c* for moving the toner supplying container 301 which is engaged with a toner supply port open/close means (not shown) of the container receiving table 50 disposed in the apparatus main body 100 in an attaching/detaching direction.

In this embodiment, the engaging portion 301*c* is formed of a dowel that projects from the lower surface 301D toward the outer side. Also, the upper surface 301E is equipped with a grip 301*e* which is gripped by the user when the toner supplying container 301 is mounted in the apparatus main body 100 or is taken out from the apparatus main body 100. Also, on the downward inclined surface (curved portion) 301F of the front surface and the back surface, a groove 301*f* for making it easy to catch the container main body 301A when the user mounts the toner supplying container 301 in the apparatus main body 100 is formed substantially in parallel with the longitudinal direction of the container main body 301A. The curved portion 301F is formed of a part of a cylinder that centers a shaft portion 302A of the feeding member 302.

Also, a second receiving portion 301*b*2 for rotatably supporting the agitating member 305 is disposed above the first receiving portion 301*b*1 of the other side surface 301B.

In this example, the toner supply opening portion 301*a* is disposed along a side surface 301A1 opposite to a side surface 301B at which the grip 301*e* is disposed along the longitudinal direction of the container main body 301A. Therefore, the user can be prevented from unintentionally touching the toner supply opening portion 301*a* when the user mounts the toner supplying container 301 in the apparatus main body 100. Also, the toner supply opening portion 301*a* is disposed below the side surface 301A1. Therefore, even if the toner contained in the container main body 301A is lessened, the toner can be efficiently discharged.

In this example, the toner supply opening portion 301*a* is projected from one side surface 301A1 by 20 to 40 mm, preferably about 27.8 mm. Also, the toner supply opening portion 301*a* is cylindrical and the outer diameter of the cylindrical portion is 20 mm to 30 mm, preferably 26 mm to 29 mm, more preferably about 27.6 mm.

Also, as described above, the outer side of the lower surface 301D is provided with the engaging portion 301*c*. The engaging portion 301*c* is positioned by an engaging portion disposed in the apparatus main body 100 when the toner supplying container 301 is mounted in the apparatus main body 100. As described above, the engaging portion 301*c* is a cylindrical dowel that projects from the lower surface 301D toward the exterior. The outer diameter of the cylindrical portion is 5 mm to 12 mm, preferably about 8 mm. Also, the engaging portion 301*c* is positioned at 2 mm to 8 mm from the lower surface 301D, and the engaging portion 301*c* (positioning portion) is disposed at a position of 60 mm to 80 mm, preferably about 71 mm from a side end surface opposite to a side where the toner supply opening portion 301*a* is positioned in the longitudinal direction of the lower surface 301D.

The engaging portion (positioning portion) 301*c* is preferably cylindrical, but may be rectangular-columnar or semi-circular.

Note that on one side surface 301A1 and the other side surface 301B are disposed two bosses 301*k* and 3011 for positioning the container main body 301A when testing the dimensions of the container main body 301A before shipping from a factory, respectively.

Also, reference numeral 301*m* is a rib for prevention of a mounting error.

With the provision of the ribs 301*m* at different positions for each of the toner supplying containers 301, the user can be prevented from mounting another kind of toner supplying container in the apparatus main body 100.

It is preferable that the container main body 301A is manufactured using resin such as plastic through an integral molding method such as an injection molding, a blow molding or an injection blow molding. However, other materials or manufacturing methods may be applied. Further, the container main body 301A may be manufactured through a method in which the container main body 301A is divided into two pieces or more for convenience, and those pieces are integrated together by a welding, bonding or other means.

In this embodiment, the container main body 301A is manufactured by vibration-welding two frames consisting of an upper frame and a lower frame which have been injection-molded with high impact polystyrene.

Also, the feeding member 302 includes the shaft portion 302A and a spiral-shaped and rigid feed blade 302B that is disposed on the shaft portion 302A and functions as a feeding portion which feeds the powder toner in a predetermined direction by the rotation of the shaft portion 302A as shown in FIG. 6. Then, the feeding member 302 is attached to the container main body 301A in a state where the axis line of the shaft portion 302A substantially coincides with the center of the toner supplying portion 301*g* which is substantially circular.

Note that the feeding member 302 is not limited to a so-called screw type which was described in this embodiment, but may be applied to the shaft portion 302A to which a flexible blade is fitted. Also, the shaft portion and the blade may be integrally molded or separated. In this embodiment, the shaft portion 302A and the blade 302B are integrally molded with plastic.

Further, in this embodiment, the feeding member 302 has an extending portion of the toner supply opening portion 301*a* as shown in FIG. 7. In this embodiment, the extending portion 302*c* is further projected toward the exterior of the toner supply opening portion 301*a*. Then, the leading edge portion projected toward the exterior of the extending portion 302*c* receives the rotary drive force from the apparatus main body 100. For that reason, in this embodiment, the sealing member 303 is movably attached to the leading portion in the axial direction.

In this example, one end portion (drive force receiving portion) 302*a* of the extending portion 302*c* is so shaped as to receive the rotary drive force from the apparatus main body 100 through the sealing member 303. In this embodiment, the one end portion 302*a* is polygonal in section, in particular, rectangular. Then, one end portion of the shaft portion 302A is supported by the sealing member 303 through the one end portion 302*a* of the extending portion 302*c*. Also, a first bearing member 308 is disposed in the other end portion 302*b* of the shaft portion 302A. Then, the feeding member 302 is rotatably supported to the container main body 301A through the first bearing member 308.

Also, the feeding member 302 is supported by the sealing member 303 so that the inner wall surface 301*a* of the toner supply opening portion 301*a* and one end portion 302*a* of the shaft portion 302A are substantially horizontal. Then, with the feeding member 302 supported in this way, the feeding member 302 is rotated, thereby making it possible to feed the toner toward the toner supply portion 301*g* substantially horizontally. Also, it can prevent the fine toner from being lodged between the inner wall surface 301*a*I of the toner supply opening portion 301*a* and the feeding blade 302B, and then being subjected to strong sliding friction. Therefore, the toner is not allowed to melt and become fixed onto the inner wall surface 301*a* thereby forming coarse powders.

As described above, it is preferable that the feeding member 302 is also manufactured through an injection molding method or the like using a resin such as plastic because this method is simple. However, other materials or other manufacturing methods may be applied. Also, division and bonding may be arbitrarily made for manufacturing.

Figure 10A:
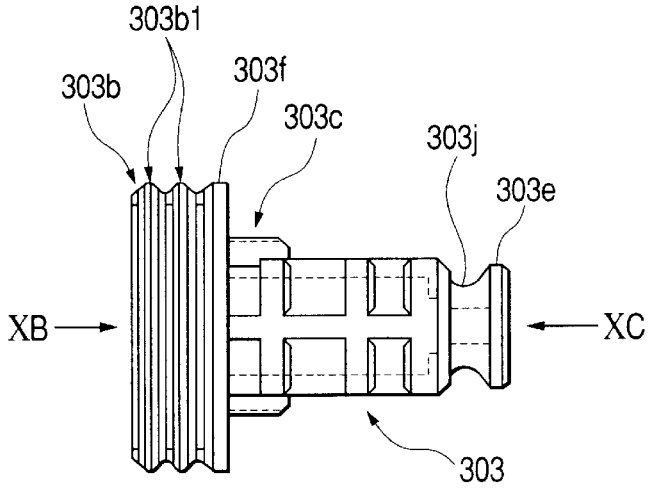
FIG. 10A is a front view showing the sealing member.

Then, the sealing member 303 will be described with reference to FIGS. 10A to 10D. FIG. 10A is a front view showing the sealing member, FIG. 10B is a view looking in the direction of the arrow XB of FIG. 10A, FIG. 10C is a view looking in the direction of the arrow XC of FIG. 10A, and FIG. 10D is a front cross-sectional view thereof.

Figure 10B:
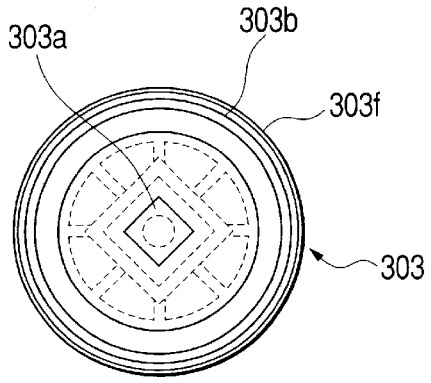
FIG. 10B is a view looking in a direction of an arrow XB of FIG. 10A.
Figure 10C:
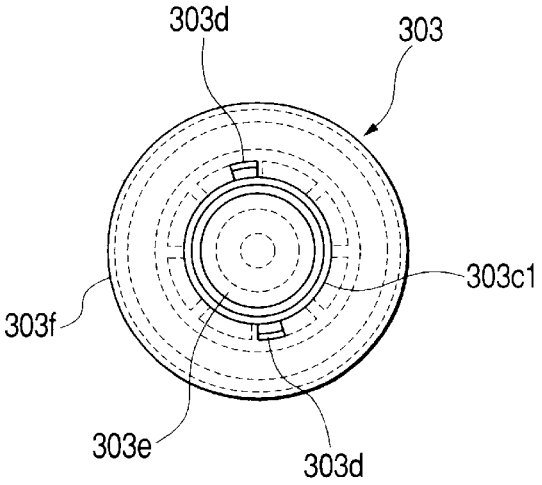
FIG. 10C is a view looking in a direction of an arrow XC of FIG. 10A.
Figure 10D:
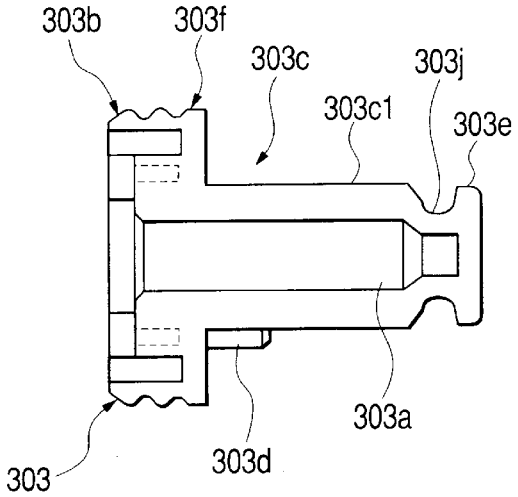
FIG. 10D is a front cross-sectional view thereof.

Referring to FIGS. 10A, 10B and 10D, reference character 303*b* denotes a sealing portion that is disposed at a side of the sealing member 303 opposite to the toner supplying container 301 and unsealably seals the toner supply port 301*g* of the toner supplying container 301. The sealing portion 303*b* is designed such that the outer diameter is set to be larger than the inner diameter of the toner supply portion 301*g* by an appropriate amount. Then, the fitting portion 303*b*1 of the protruded threads in the peripheral direction of the sealing portion 303*b* is force-fitted into the toner supply opening portion 301*a* from the toner supply port 301*g*, resulting in sealing member 303 sealing the toner supply port 301*g*.

Reference character 303*c* denotes a coupling engaging portion that functions as a drive force transmitted portion (drive portion) for receiving a drive force used to rotate the feeding member 302 from the apparatus main body 100 when the toner supplying container 301 is mounted in the apparatus main body 100. The coupling engaging portion 303*c* has a projecting portion 303*c*1 that extends on the substantially same axis line as that of the shaft portion 302A of the feeding member 302 in a direction opposite to the toner container main body 301A from the sealing portion 303*b* when the sealing member 303 is mounted to the container main body 301A. Also, the coupling engaging portion 303*c* has a slender (spline shaped) protrusion (rib) 303*d* that functions as a drive force receiving portion which is engaged with the coupling member 304. In this embodiment, two spline protrusions 303*d* are disposed at a substantially regular interval. specifically, two splines are disposed at an interval of about 180° with the longitudinal direction of the sealing member 303 as a center.

Also, the rib 303*d* is radially projected from the projected portion 303*c*1 of the sealing member 303 by 0.5 mm to 3 mm, preferably about 1.8 mm.

Also, the outer diameter of the projected portion 303*c*1 is set to 10 mm to 14 mm, preferably about 12 mm.

Incidentally, the sealing member 303 has an engaging hole 303*a* as a drive force transmitting portion for transmitting the drive force received from the apparatus main body 100 by engagement with the one end portion 302*a* of the feeding member 302 to the feeding member 302. The engaging hole 303*a* is made up of openings (cavity portions) formed over a portion where the sealing portion 303*b* and the coupling engaging portion 303*c* are formed. In this example, the engaging hole 303*a* has a rectangular shape corresponding to the rectangular shape of the axial end portion 302*a* of the feeding member 302 which projects from the toner supply opening portion 301*a*. Then, the engaging hole 303*a* is so formed as to be larger than the axial end portion 302*a*, with the result that the axial end portion 302*a* is loosely fitted into the engaging hole 303*a*.

Then, the axial end portion 302*a* is loosely fitted into the engaging hole 303*a* in this way, whereby the feeding member 302 and the sealing member 303 are engaged with each other in the rotating direction of the feeding member 302. On the other hand, the feeding member 302 and the sealing member 303 are movable to each other in the axial direction. As a result, when the toner supplying container is mounted onto the apparatus main body, the sealing member 303 and the container main body 301A can be apart from each other, thereby making it possible to unseal (open) the toner supply port 301*g*.

Incidentally, the engagement length of the engaging hole 303*a* and the axial end portion 302*a* is to a degree in which the engaging hole 303*a* and the axial end portion 302*a* are not separated from each other when the sealing member 303 and the container main body 301A are apart from each other. As a result, even if the sealing member 303 is apart from the container main body 301A, the feeding member 302 can receive the drive force through the sealing member 303 (coupling engaging portion 303*c*).

Also, a collar portion 303*f* that abuts against the end portion of the toner supply opening portion 301*a* when the sealing portion 303*b* is force-fitted into the toner supply opening portion 301*a* is disposed between the coupling engaging portion 303*c* and the sealing portion 303*b*. The outer diameter of the collar portion 303*f* is substantially equal to the outer diameter of the toner supply opening portion 301*a* (preferably, smaller than the outer diameter of the toner supply opening portion 301*a*). The sealing portion 303*b* is force-fitted into the toner supply opening 301*a* by the collar portion 303*f* by a length as long as the sealing portion 303*b*.

On the other hand, reference numeral 303*e* denotes an engaging protrusion 303*e* which functions as an engaging portion which is formed in a leading end of the coupling engaging portion 303*c* and engaged with the engaging member 6 disposed in the apparatus main body (refer to FIG. 6). The engaging member 6 is engaged with the engaging protrusion 303*e*, thereby making it possible to fix the sealing member 303 when the toner supply port 301*g* is unsealed.

Incidentally, it is preferable that the sealing member 303 thus structured is manufactured by injection molding with a resin such as plastic, but other materials or manufacturing methods may be applied and division and bonding may be arbitrarily made for manufacturing. Also, the sealing member 303 is required to provide an appropriate elasticity because the sealing member 303 is force-fitted into the toner supply opening portion 301*a* and tightly seals the toner supply opening portion 301*a*. The material is most preferably low-density polyethylene, and more preferably polypropylene, nylon, high-density polyethylene and the like.

Reference character 303*j* denotes a peripheral engaging groove fitted into the engaging member 6 disposed in the apparatus main body 100. The width of the engaging groove 303*j* is set to 1.5 mm to 5 mm, preferably about 3 mm. Also, the depth of the engaging groove 303*j* is set to 0.5 mm to 5 mm, and preferably about 2.5 mm.

As described above, the sealing member 303 has a substantially cylindrical fitting portion 303*b*1 which is fitted into the toner supply opening portion 301*a*. Then, the sealing member 303 has a collar portion 303*f* on substantially the same axis line as that of the fitting portion 303*b*1. In addition, the sealing member 303 has a projecting portion 303*c*1 that projects on substantially the same axis line of that of the fitting portion 303*b*1 on a side opposite to a side where the fitting portion 303*b*1 is disposed from the collar portion 303*f*, and a protrusion 303*d*of the drive force receiving portion is disposed on the base of the projecting portion 303*c*1. Also, the leading edge portion of the projecting portion 303*c*1 in the projecting direction is provided with an engaging groove 303*j*, and the leading end is provided with an engaging portion 303*e*. Also, the sealing member 303 as a cavity portion extending from the fitting portion 303*b*1 side toward the engaging portion 303*e* side, and an engaging hole 303*a* is defined in the cavity portion as the drive force transmitting portion. Since the engaging portion 303*e* side of the cavity portion is not opened, there is no case in which the toner that has entered the cavity portion is leaked to the exterior of the container main body 301A when the fitting portion 303*b*1 is fitted into the toner supply opening portion 303*a*. Therefore, the toner supply opening portion 301*a* is sealed by fitting the sealing member 303.

In this embodiment, the sealing member 303 has the following four functions.

That is, 1) a function of sealing the toner supply opening portion 301*a*; 2) a function of receiving the transmission of a rotary drive force from the apparatus main body 100; 3) a function of transmitting the rotary drive force to the feeding member 302; and 4) a function of engaging with the engaging member 6 disposed in the apparatus main body 100 for opening and closing the toner supply opening portion 301*a*. Therefore, the drive force received by the sealing member 303 from the apparatus main body 100 is transmitted to the shaft portion 302A through the extending portion 302*c*, thereby making it possible to rotate the feeding member 302.

Figure 11A:
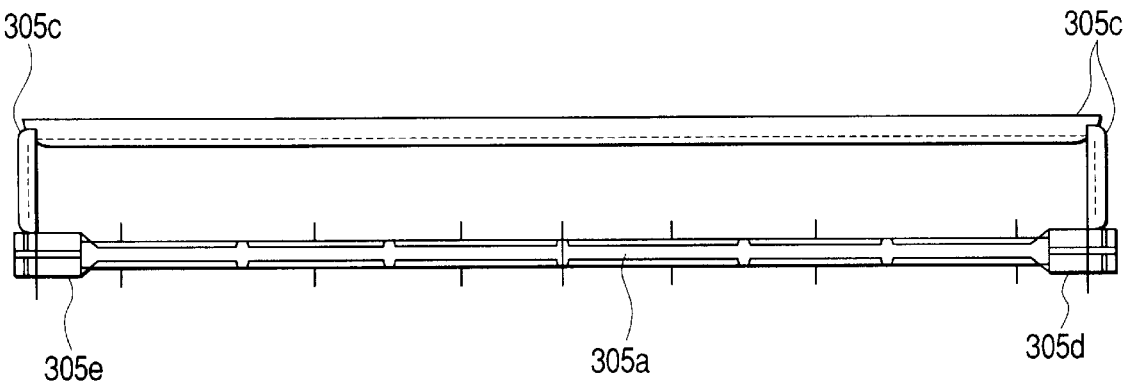
FIG. 11A is a front view showing an agitating member.
Figure 11B:
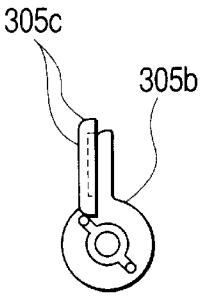
FIG. 11B is a left side view thereof.
Figure 11C:
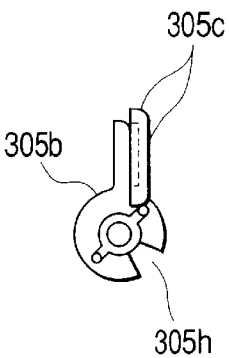
FIG. 11C is a right side view thereof.
Figure 12:
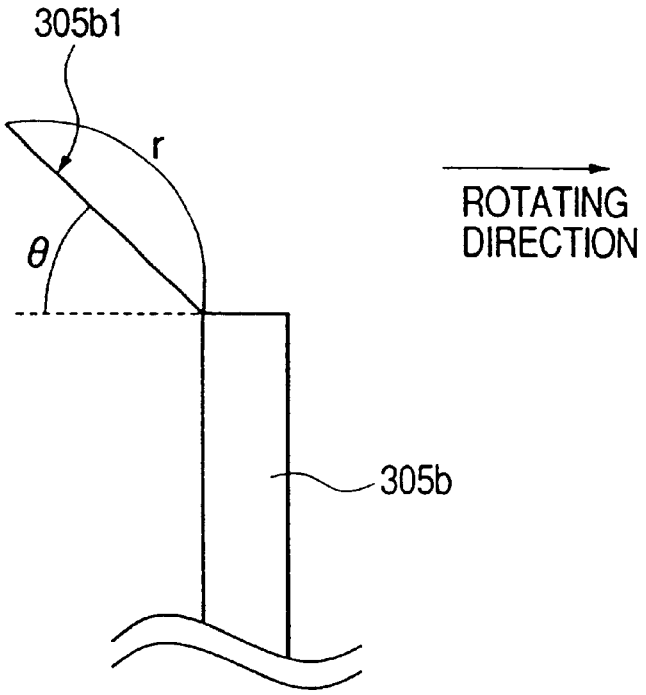
FIG. 12 is an enlarged side view showing a rigid blade portion.
Figure 13:
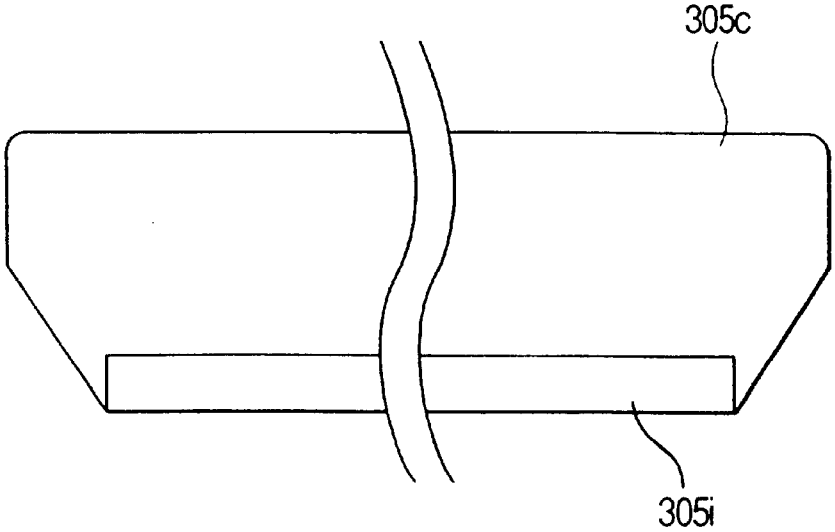
FIG. 13 is an enlarged view showing a flexible blade portion.

The agitating member 305 will now be described. FIG. 11A is a front view showing an agitating member, FIG. 11B is a right side view thereof, and FIG. 11C is a left side view thereof. As shown in FIGS. 11A to 11C, the agitating member 305 has a shaft portion 305*a* and a rigid wing portion 305*b* and a flexible wing portion 305*c* which serve as the agitating portion. FIG. 12 shows an enlarged side view of the rigid wing portion 305 and FIG. 13 is an enlarged view of the flexible wing portion 305*c*. The shaft portion 305*a* is manufactured by injection molding plastic that is relatively high in rigidity. The rigid wing portion 305*b* is made of a metal such as stainless, or a material very high in rigidity. The flexible wing portion 305*c* is made of a flexible material, for example, a plastic film or sheet, or an elastomer sheet. In this embodiment, a polyester sheet is used.

In the bearing portion 301*h* of the toner supplying container main body 301A, one end 305*d* of the agitating member 305 is engaged with the above-mentioned transmitting member 306. Also, the other end 305*e* of the rotary shaft of the agitating member 305*d* is engaged with a stopper member (second bearing member) 310 that serves as a rotary portion that rotates together with the rotary shaft of the agitating member in the second receiving portion 301*b*2 of the toner supplying container main body 301A. Also, the shaft portion 305*a* is formed by injection molding a plastic relatively high in rigidity in this embodiment, but a material such as metal may be employed.

It is preferable that the rigid wing portion 305*b* is integrally formed with metal or the like because it is simple. However, other materials or manufacturing methods may be applied, and the rigid wing portion 305*b* may be divided into two pieces or more, and those pieces may be integrated together by a welding, bonding or other means. In this embodiment, the rigid wing portion 305*b* is formed of a stainless plate about 0.8 mm in thickness which has been pressed. Also, the engaging portion of the rigid wing portion 305*b* with the shaft portion 305*a* is so shaped as to correspond to the shaft portion 305*a* to receive the drive from the shaft portion 305*a*. The rigid wing portion 305*b* rotates together with the rotary motion of the shaft portion 305*a* and agitates the toner within the container while being in contact with the inner wall of the container.

In this situation, when a notch 305*h* is formed on one end of the rigid wing portion 305*b* as shown in FIG. 11C, assembling is more readily facilitated. In addition, a portion which is in parallel with the shaft portion 305*a* of the rigid wing portion 305*b* is plate-shaped so as to be substantially in parallel with the tangent of a rotary locus over the entire length. The downstream side of the wing portion in the rotating direction is bent toward the toner supplying container 301 inner wall side. It is preferable that the length r of the bent portion 305*b* 1 shown in FIG. 12 is set to about 2 mm to 8 mm, and a bent angle θ is set to 30° to 50°. More preferably, the length r of the bent portion 305*b*1 is set to about 3 mm to 5 mm, and the bent angle θ is set to about 45°.

In this embodiment, the length of the bent portion 305*b*1 is set to about 5 mm, and the bent angle is set to about 45°. A distance from the center of the rotary axis to the leading end of the rigid wing portion is appropriately determined in accordance with the size of the container main body 301A, but may be preferably set to be about 70 to 95% of the inner radius of the container main body. In this embodiment, since the inner radius of the container main body is about 44.5 mm, it is set to about 39.4 mm (89%). The bent portion 305*b*1 of the rigid wing portion 305*b* is apart from the inner wall surface of the container main body 301A.

The flexible wing portion 305*c* is made of a material low in rigidity, for example, a flexible member such as a sheet of PET (polyethylene terephthalate), PE (polyethylene), PP (polypropylene) or PPS (polyphenylene sulfide). The thickness of the flexible wing portion 305*c* is preferably set to about 50 to 500 μm, and more particularly 100 to 300 μm. In this embodiment, a polyester sheet of about 100 μm in thickness is used.

The flexible wing portion 305*c* is stuck onto the entire length of the bent portion 305*b*1 of the rigid wing portion 305*b* in such a manner that the leading end is in contact with the inner wall surface of the container main body. Then, the flexible wing portion 305*c* rotates while scrapping off the toner from the container inner wall surface in cooperation with the rigid wing portion 305*b*. The length of the flexible wing portion 305*c* in the rotation radius direction and the length of the flexible wind portion 305*c* in the wall surface direction which is substantially in parallel with the rotary axis are so set to be longer than a distance from the leading edge of the rigid wing portion 305*b* to the container inner wall surface by about 0.5 mm to 10 mm. With this structure, the abovementioned effect in which the amount of toner that remains in the toner supplying container when the use of the toner has been completed is lessened can be further enhanced.

As described above, the structure in which the length of the flexible wing portion 305*c* in the rotation radius direction and the length of the flexible wind portion 305*c* in the wall surface direction which is substantially in parallel with the rotary axis are so set to be longer than a distance from the leading edge of the rigid wing portion 305*b* to the container inner wall surface means that the agitating blade enters the container wall surface (the inner walls of the curved portion 301F, one side surface 301A1, and the other side surface 301B).

In this embodiment, the radial length of the flexible wing portion 305*c* is set to be longer than the distance from the leading edge of the rigid wing portion 305*b* to the container inner wall surface by about 6 mm. Also, in this embodiment, the adhesive of the rigid wing portion 305*b* and the flexible wing portion 305*c* is made in such a manner that an adhesive double coated tape 305*i* (product mark DIC #8800CH) is stuck onto the bent portion 305*b* of the rigid wing portion 305*b* as shown in FIG. 13. Alternatively, a well-known means such as riveting or caulking may be used, or the flexible wing portion 305*c* may be molded integrally with the rigid wing portion 305*b*.

Figure 14C:
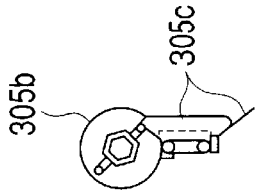
FIG. 14C is a right side view thereof.
Figure 14A:
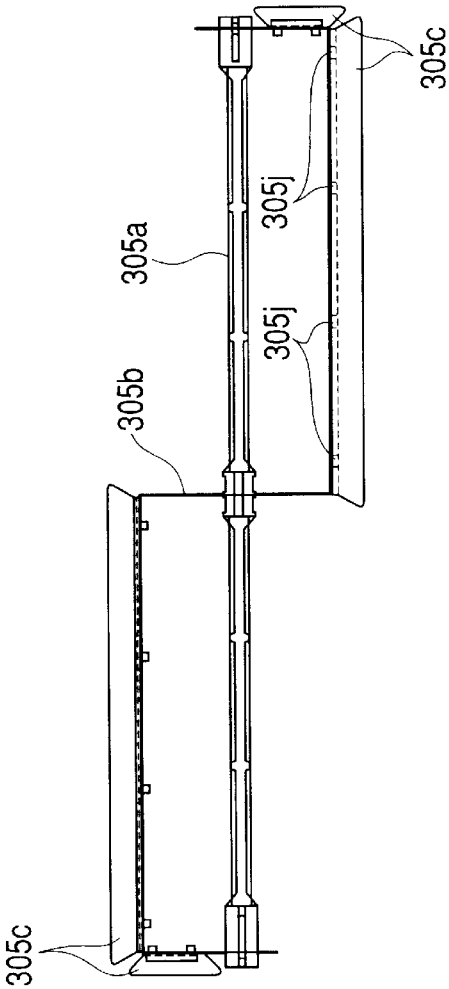
FIG. 14A is a front view showing an agitating member in accordance with another embodiment.
Figure 14D:
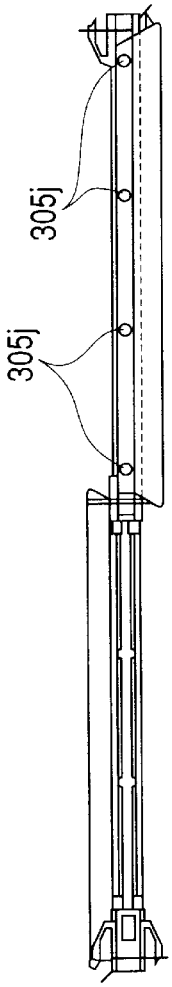
FIG. 14D is a bottom view thereof.
Figure 14B:
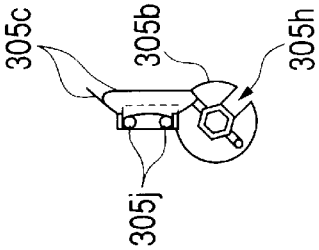
FIG. 14B is a left side view thereof.

In FIGS. 14A to 14D, there is shown an example in which the rigid wing portion 305*b* is divided at the substantially center portion so as to provide a phase difference of 180 degrees with respect to the axial direction so as to be shaped into a zigzag. In this example, the number of divisions may be appropriately determined in accordance with the shape and the length of the container main body, and the rigid wing portion 305*b* may be divided into three pieces or four pieces or more in the longitudinal direction or in the peripheral direction. Also, the rigid wing portion 305*b* may be continuously changed in phase over the entire longitudinal length into a spiral shape. Also, if a notch 305*h* is formed in the engaging portion of both end portions of the rigid wing portion 305*b* of both end portions of the rigid wing portion 305*b* and the shaft portion on substantially the center portion thereof as shown in FIG. 14B, assembly can be improved. In order to make the projection area of the rigid wing portion 305*b* in the rotational direction small and reduce the resistance of the toner, the length of the rigid wing portion 305*b* in the rotational direction small and reduce the resistance of the toner, the length of the rigid wing portion bent portion 305*b*1 is set to about 3 mm. The length r and the bent angle θ of the bent portion 305*b* 1 are preferably set to about 2 to 8 mm and about 30 to 50 degrees, and more preferably about 3 to 5 mm and about 45 degrees.

Also, as a means for bonding the rigid wing portion 305*b* and the flexible wing portion 305*c*, the adhesive double coated tape may be replaced by an aluminum rivet 305*j* for caulking. In this example, since flapping may occur if the rivet hole of the flexible wing portion 305*c* is even slightly displaced, a portion of the flexible wing portion 305*c* which abuts against the bent portion 305*b*1 of the rigid wing portion 305*b* may be scored or half-cut. Also, as a sticking means, other conventional methods, such as an adhesive double-coated tape may be applied.

Subsequently, a method of assembling the toner supplying container 301 will be described.

In a method of assembling the toner supplying container 301, the feeding member 302 is first inserted into the lower portion of the lower frame 301K from the upper. Then, after the oil seal 309 has been inserted into the first receiving portion 301*b*1, the bearing member 308 is engaged with the other end portion 302*b* of the feeding member 302. In addition, the toner supply port 301*g* is sealed with the sealing member 303.

Then, the agitating member 305 is inserted from the upper. Then, after the oil seal 309 has been inserted into the container main body 301A, the second bearing member 310 and the transmitting member 306 are engaged with both ends of the agitating member 305. Thereafter, the upper frame 301J is vibration-welded with the lower frame 301K.

Then, a given amount of toner is filled in the interior of the container main body 301A through the toner filling port 301*i* of the toner supplying container 301 main body, and the toner filling port 301*i* is sealed with the sealing member 311 to complete the assembling. In this way, the assembling of the toner supplying container 301 is extremely simple, and the number of assembling processes is also very reduced.

The filling of the toner may be conducted by the toner supply port 301*g*.

When the toner supply opening portion 301 has been unsealed by the above-mentioned toner supply portion open/close means, a force is applied to the toner supply opening portion 301*a* and the engaging protrusion 301*c*. (See FIG. 15). The force mainly draws the sealing member 303 from the toner supply opening 301*a*. In this situation, as described above, since the engaging protrusion 301*c* is disposed at a side opposite to the side where the toner supply opening portion 301*a* is positioned in the longitudinal direction of the lower surface of the container main body 301A, the container main body 301A can be suppressed from lifting with respect to the apparatus main body 100. Note that if the container main body 301A lifts up, the upper surface 301E is abutted against the ceiling surface 100*d* (refer to FIG. 15) disposed on the apparatus main body 100, thereby making it possible to prevent the container main body 301A from moving upward by a given distance or more.

Figure 15:
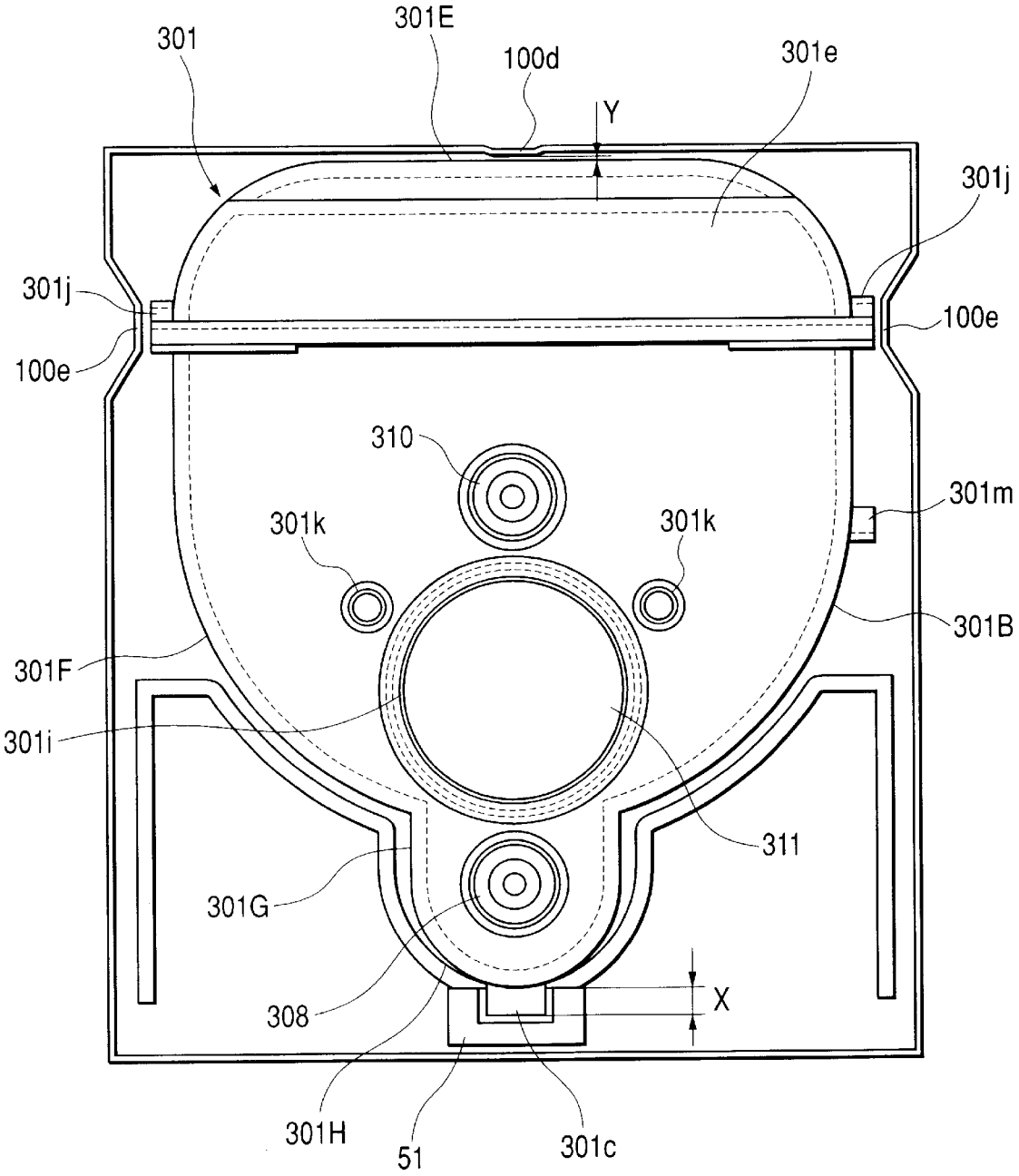
FIG. 15 is a side view showing a state in which the toner supplying container is mounted on the apparatus main body.

Also, it is desirable that the engaging protrusion 301*c* and the toner supply port 301*g* of the toner supplying container 301 are disposed on the same perpendicular line with respect to the slide direction of the toner supplying container 301 as shown in FIG. 15. With this structure, any moment in the right and left directions can be prevented from occurring in the toner supplying container 301 with respect to the slide direction in FIG. 15. Even if the moment in any direction occurs, the ribs 301 i that serve as the laterally regulating portion disposed on the side surface 301A1 and the other side surface 301B are abutted against the side wall portion 100*e* disposed on the apparatus main body 100, thereby making it possible to prevent the container main body 301A from moving in the lateral direction by longer than a given distance.

Incidentally, the height of the engaging protrusion 301*c* of the toner supplying container 301 is set in such a manner that in order to prevent the toner supplying container 301 from falling upward during the slide movement, the engaging margin X (refer to FIG. 15) of the engaging protrusion 301*c* and the engaging portion 51 which is a container chucking member is set to be larger than a clearance Y (refer to FIG. 15) of the container upper surface 301E and the ceiling portion 100*d* of the apparatus main body 100.

Also, in order to take up any play or stop, it is desirable that the ribs 301*j* of the toner supplying container 301 in the right and left direction in FIG. is disposed on the upper portion of the toner supplying container 301, and in this embodiment, the ribs 301*j* are so disposed as to be higher than the center portion of the toner supplying container 301 in the heightwise direction with an appropriate clearance therebetween.

Subsequently, the drive mechanism of the toner supplying container 301 according to this embodiment will be described.

When the toner supplying container 301 is mounted on the apparatus main body, the coupling engaging portion 303*c* of the sealing member 303 shown in FIG. 10A is engaged with the first coupling member 304 at the apparatus main body 100 side as shown in FIG. 6. In this example, the first coupling member 304 is so designed as to transmit the drive force of the drive device (not shown) disposed at the apparatus main body 100 side to the sealing member 303.

Figure 16:
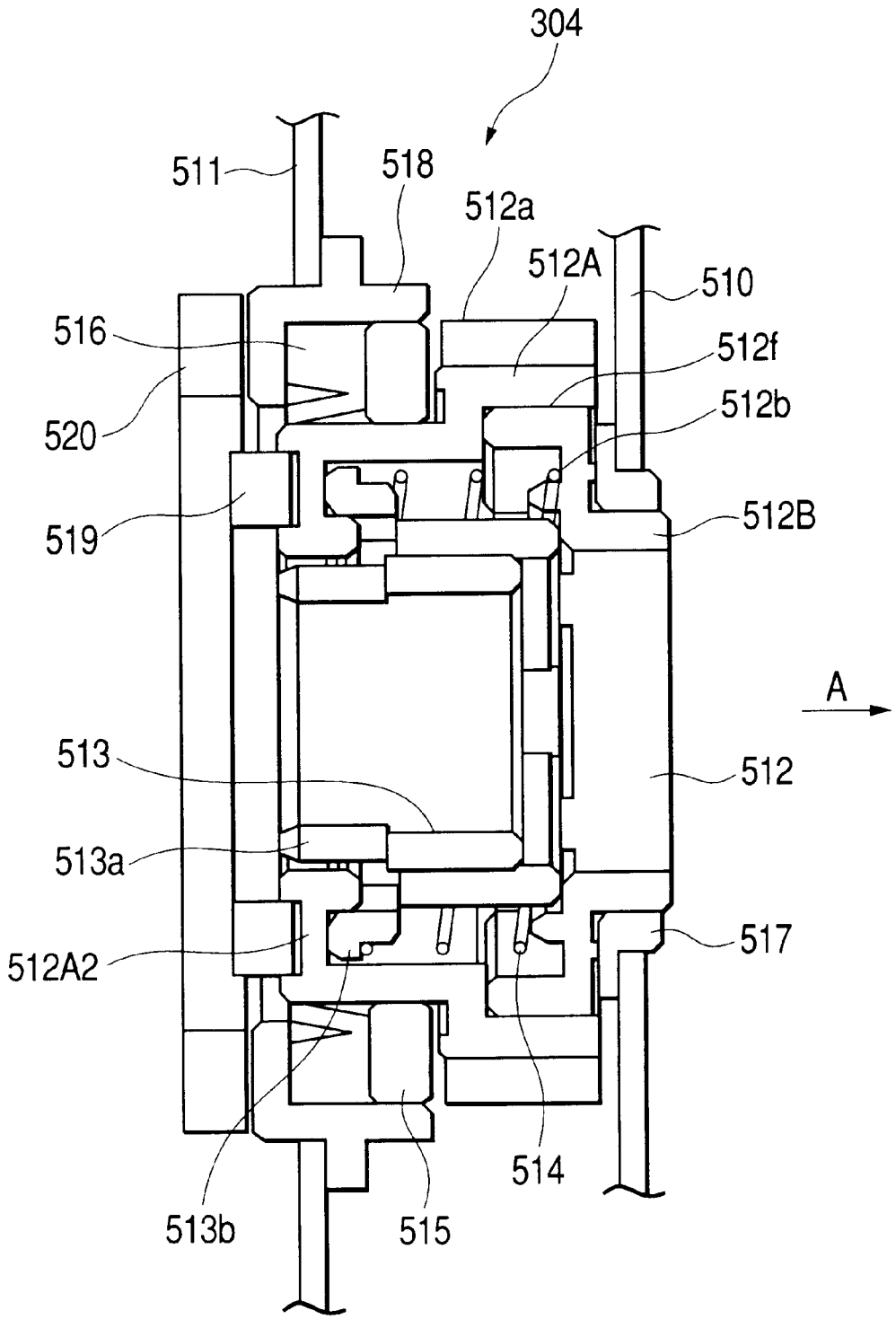
FIG. 16 is a vertical cross-sectional view showing a detailed configuration of a first coupling member.

FIG. 16 is a view showing the detailed shape of the first coupling member 304.

Reference numeral 512 denotes a gear member having an outer peripheral surface 512*a* formed with the tooth portions of a gear. The gear tooth of the outer peripheral surface 512*a* is engaged with the gears (not shown) continuous to the drive source of the apparatus main body 100. The gear member 512 is made up of two members consisting of a gear portion 512A and a cap portion 512B, and those portions 512A and 512B are fixed to each other at the fitting portion 512f through snap fitting, bonding or the like. The interior of the gear member 512 is equipped with an urging means 514 and a moving member 513. The urging means 514 is abutted against a spring seat 512*b* of the gear member 512 and a spring seat 513*b* of the moving member 513. The urging means 514 is formed of a compression coil.

Figure 17A:
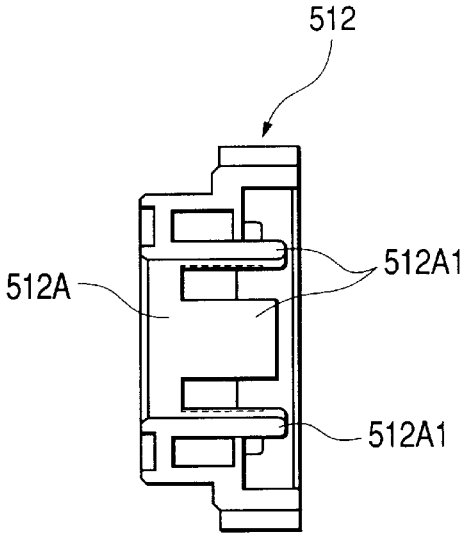
FIG. 17A is a vertical cross-sectional view showing the details of a gear portion.
Figure 17B:
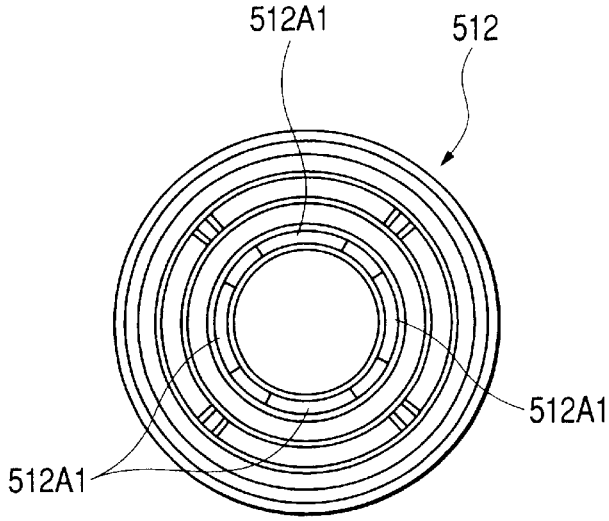
FIG. 17B is a right side view thereof.
Figure 17C:
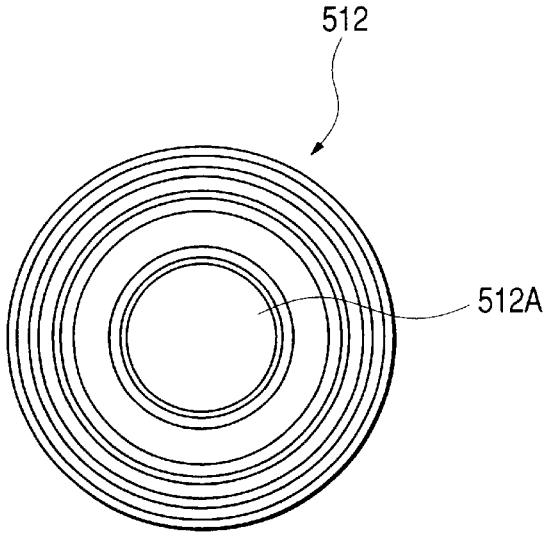
FIG. 17C is a left side view thereof.
Figure 18A:
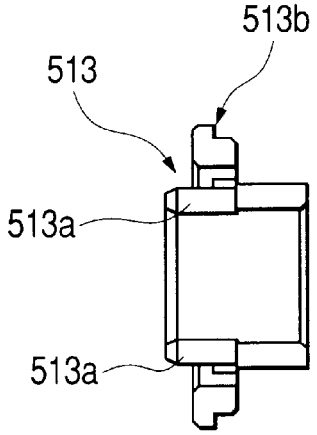
FIG. 18A is a vertical cross-sectional view showing the details of a moving member.
Figure 18B:
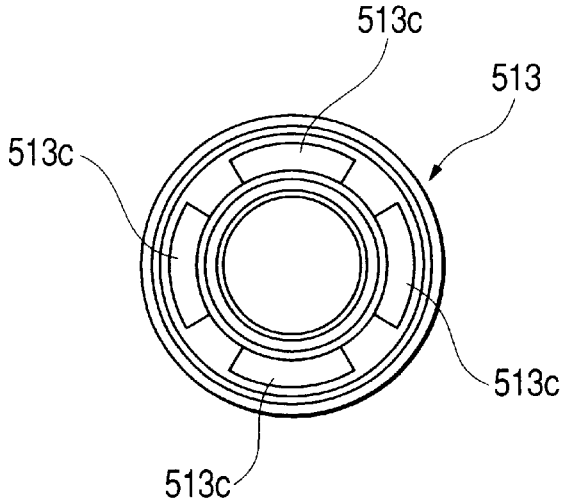
FIG. 18B is a right side view thereof.
Figure 18C:
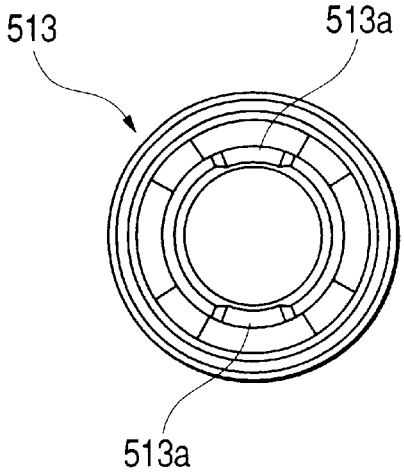
FIG. 18C is a left side view thereof.
Figure 18D:
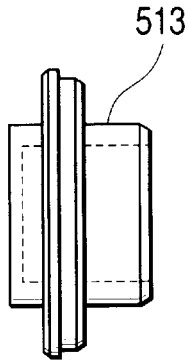
FIG. 18D is a front view thereof.

FIGS. 17A to 17C are views showing the details of the gear portion 512A, in which FIG. 17A is a front cross-sectional view thereof, and FIGS. 17B and 17C are side views thereof. Also, FIGS. 18A to 18D are views showing the details of the moving member 513, in which FIG. 18A is a front cross-sectional view thereof, FIGS. 18B and 18C are side views thereof, and FIG. 18D is a front view thereof.

In FIGS. 17A and B, the gear portion 512A has four slide guiding ribs 512A1 which face the axial direction in the direction of circumference at equal intervals. In FIG. 18B, the moving member 513 has four slide guiding holes 513*c* in the direction of circumference at equal intervals. The moving member 513 can slide in the axial direction in the inner portion of the gear member 512 by being engaged with the above-mentioned slide guide ribs 512A1 of the gear portion 512A.

In the moving member 513, reference numeral 513*a* denotes a grooved drive transmitting portion. In a state where the toner supplying container 301 is mounted on the apparatus main body 100, the drive transmitting portion 513*a* is engaged with the slender protrusion 303*d* (refer to FIGS. 10C and 10D) of the sealing member 303, and transmits the rotation drive to the sealing member 303.

Referring to FIG. 16, reference numerals 517 and 515 denote bearing members that rotatably support the gear member 512. Reference numeral 516 denotes an oil seat. The oil seat 516 is fitted to a bearing holder 518 so that the rip is in contact with the leftmost outer periphery of the gear portion 512A. The oil seat 516 prevents the toner discharged from the toner supply port 301*g* from entering the bearing members 515 and 517 to lock the gear member 512. Reference numeral 519 denotes a gear packing member which is fixed to the left side of the gear portion 512A. In a state where the toner supplying container 301 is mounted on the apparatus main body 100, the gear picking member 519 is brought in press contact with the sealing member 303, to thereby prevent the toner discharged from the toner supply portion 301*g* from entering the gear member 512.

Reference numerals 510 and 511 denote drive side plates that support the first coupling member 304. The drive side plate 510 is fitted into the bearing member 517. The drive side plate 511 is fitted into the bearing holder 518. The drive side plates 510 and 511 denote members fixed to the apparatus main body 100. The bearing holding 518 holds the bearing 515 and the oil packing 516 and is fixed to the drive side plate 511 by a small screw or an adhesive. Reference numeral 520 denotes a holder packing member which is fixed to the left end surface of the bearing holder 518. The holder packing member 520 shown in FIG. 16 prevents the toner from being leaked from a space between the holder 5 and the bearing holder 518 shown in FIG. 6. The holder 5 is a member that constitutes a toner receiving port 9. The holder 5 forms a passage for supplying the toner between the toner supply port 301 g and the toner receiving port 9.

The gear packing member 519 and the holder packing member 520 are fixed to the gear member 512 and the bearing holder 518 by the adhesive double coated tape or the like, respectively, and made of a material having an elasticity such as a foamed urethane.

Then, the operation of the first coupling member 304 will be described. The moving member 513 of the first coupling member 304 is so structured as to be movable axially with respect to the slide guide rib 512A1 which was described with reference to FIG. 17A, thereby being capable of retracting in a direction indicated by an arrow A in FIG. 16. The moving member 513 is usually urged at a position where the spring seat 513*b* is abutted against the end plate 512A2 of the gear portion 512A by the urging means 514 as shown in FIG. 16. When the toner supplying container 301 is mounted on the apparatus main body 100, the sealing member 303 enters the first coupling member 304 as shown in FIG. 7. In this situation, when the protrusion 303*d* of the sealing member 303 and the drive transmitting portion 513*a* of the moving member 513 are in phase, the protrusion 303*d* is fitted into the drive transmitting portion 513*a*. Then, the gear member 512 and the drive member 513 rotate due to the drive of the main body not shown, and the sealing member 303 is rotated through the drive transmitting portion 513*a*. When the protrusion 303*d* of the sealing member 303 and the drive transmitting portion 513*a* of the moving member 513 are out of phase, the moving member 513 is pressed against the urging means 514 due to the protrusion 303*d* of the sealing member 303 in the direction indicated by the arrow A in FIG. 16. Then, when the gear member 512 and the moving member 513 rotate due to the drive portion of the main body, the moving member 513 runs idle until the protrusion 303*d* of the sealing member 303 and the drive transmitting portion 513*a* of the moving member 513 are in phase. Then, when they are in phase, the moving member 513 slides due to the urging means 514 until it reaches a state where the drive transmitting portion 513*a* and the slender protrusion 303*d* of the sealing member 303 are engaged with each other, and then transmits the drive to the sealing member 303.

Figure 19:
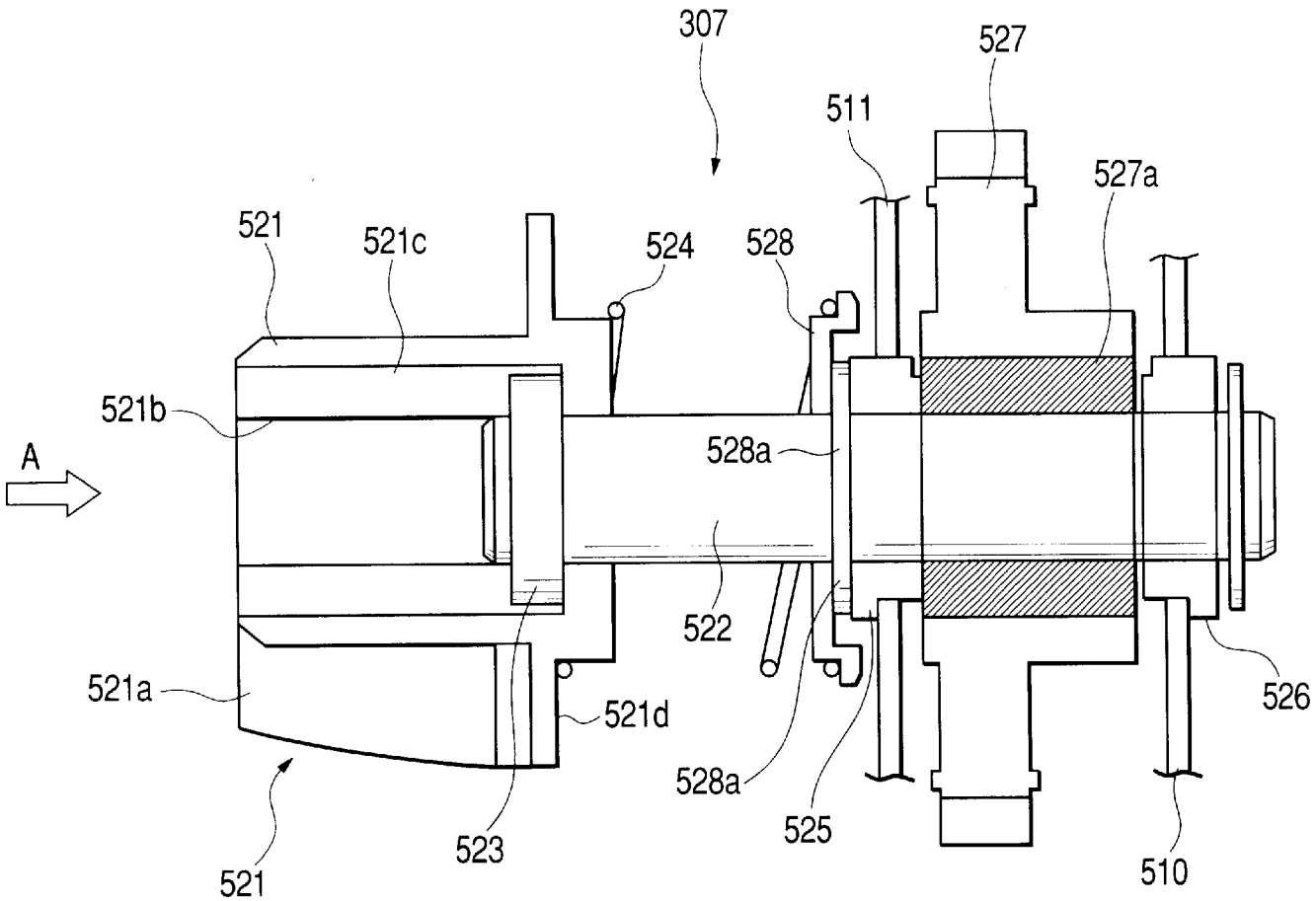
FIG. 19 is a vertical cross-sectional view showing the detailed configuration of a second coupling member.
Figure 20A:
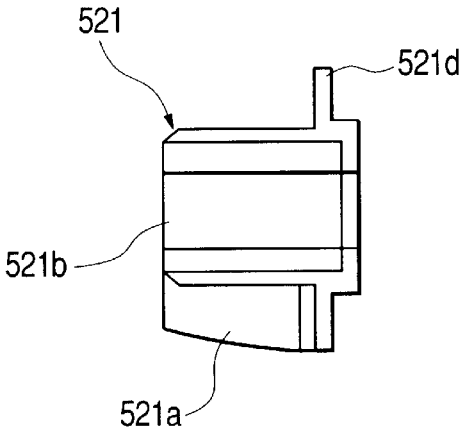
FIG. 20A is a front cross-sectional view showing a drive transmission claw.
Figure 20B:
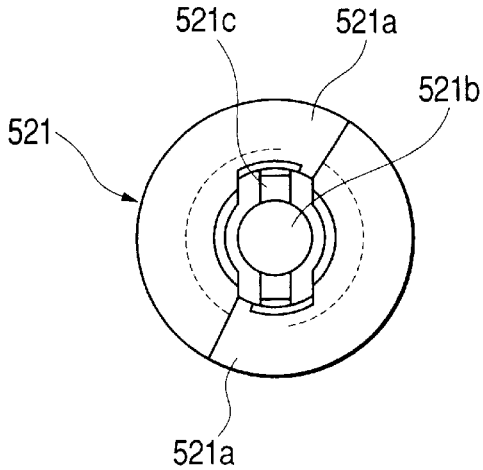
FIG. 20B is a side view thereof.
Figure 20C:
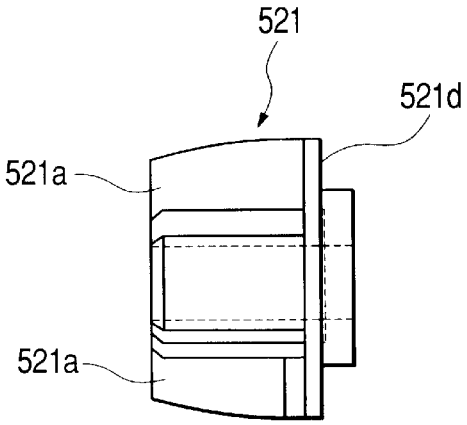
FIG. 20C is a front view thereof.
Figure 20D:
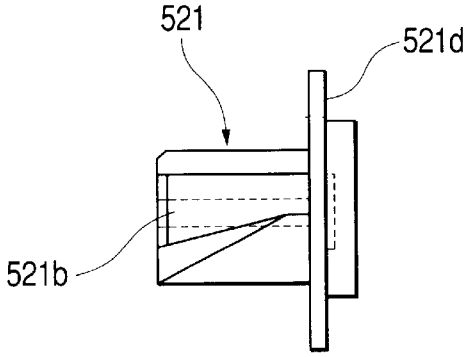
FIG. 20D is a top view thereof.
Figure 21A:
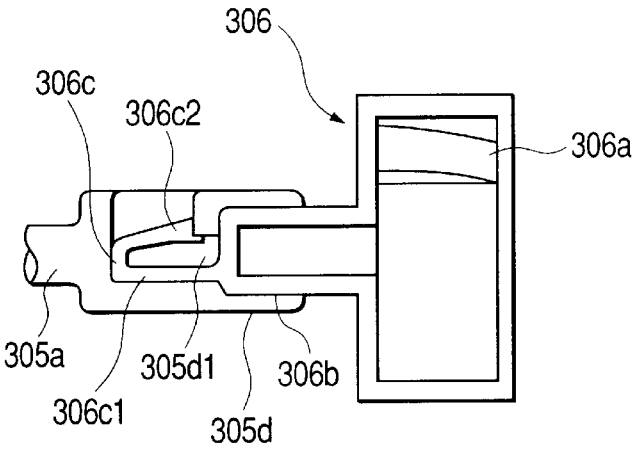
FIG. 21A is a front cross-sectional view of a transmission member.
Figure 21B:
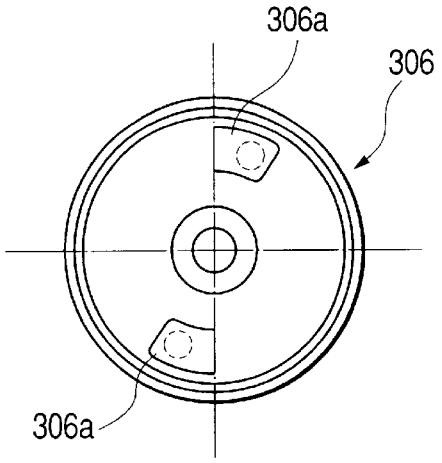
FIGS. 21B and 21C are side views thereof.
Figure 21C:
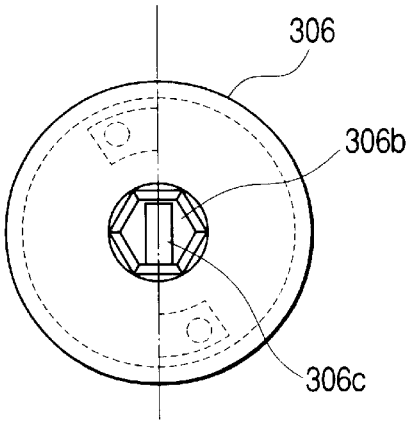
Figure 21D:
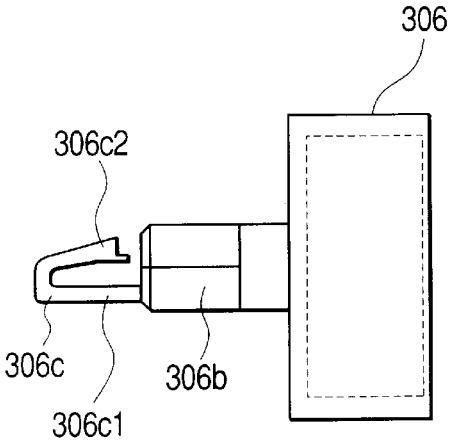
FIG. 21D is a front view thereof.

FIG. 19 is a diagram showing the detailed shape of the second coupling member 307. Reference numeral 521 denotes a drive transmission claw. FIG. 20A is a front cross-sectional view showing the drive transmitting claw 521, FIG. 20B is a side view thereof, FIG. 20C is a front view thereof, and FIG. 20D is a top view thereof. Referring to FIGS. 20A to 20D, reference numeral 521*a* denotes a claw portion, 521*b* is a slide guide portion, 521*c* is a parallel pin groove portion, 521*d* is a spring receiving surface. In this example, the claw portion 521*a* is twisted in accordance with the axial direction. FIGS. 21A to 21D are views showing the details of the transmitting member 306 shown in FIG. 6, in which FIG. 21A is a front cross-sectional view thereof, FIGS. 21B and 21C are side views thereof, and FIG. 21D is a front view thereof. Referring to FIGS. 21A to 21D, reference numeral 306*a* denotes a transmitting claw portion. The transmitting claw portion 306*a* is twisted in accordance with the axial direction. The twisting direction is identical with that of the claw portion 521*a*. In this example, when the drive transmitting claw 521 rotates, the claw portion 521*a* and the transmitting claw portion 306*a* are attracted to each other. Referring to FIG. 19, reference numeral 522 denotes a drive shaft. The drive shaft 522 is rotatably supported to the drive side plates 510 and 511 through the bearings 525 and 526. The drive shaft 522 is provided with a one-way gear 527. The one-way gear 527 is supported to the drive shaft 522 through the one-way clutch 527*a* (a member that only transmits rotation in a predetermined rotating direction). The drive transmitting claw 521 is freely fitted to the drive shaft 522 in the axial direction.

The drive transmitting claw 521 is slidable by engaging the slide guide portion 521*b* with the drive shaft 522. In other words, the slide guide portion 521*b* is a cylindrical hole which is fitted to the cylindrical drive shaft 522. The parallel pin 523 is engaged with the parallel pin groove portion 521 c, to thereby transmit the rotation of the drive shaft 522 to the drive transmitting claw 521. In this example, the parallel pin 523 is press-inserted into the drive shaft 522 over the diameter of the drive shaft 522. The parallel pin groove portion 521*c* is disposed along the generatrix of the slide guide portion 521*b*. Reference numeral 524 denotes an urging means which is abutted against the spring seat 528 and the spring receiving surface 521*d* of the drive transmitting claw 521. The spring seat 528 is fitted to the driven shaft 522 and in contact with the bearing 525 through collar 528*a*. The urging means 524 is a compression coil spring.

Then, the operation of the second coupling member 307 will be described. The drive transmitting claw 521 of the second coupling member 307 is movable in a direction indicated by an arrow A in FIG. 19 with the above-described structure, and usually urged by the urging means 524 at a position where the stop portion of the end portion of the parallel pin groove portion 521*c* of the drive transmitting claw 521 is abutted against the parallel pin 523 shown in FIG. 19. When the toner supplying container 301 is mounted in the apparatus main body 100, the transmitting member 306 is advanced to the second coupling member 307. In case of a phase where the transmitting claw portion 306*a* of the transmitting member 306 and the claw portion 521*a* of the drive transmitting claw 521 are abutted against each other, the claw portion 521*a* of the drive transmitting claw 521 rotates due to the transmitting claw portion 306*a* of the transmitting member 306. In this situation, because the driving shaft 522 also drives with the rotation of the transmitting member 306 but also runs idle at the one-way clutch 527*a* of the one-way gear 527, when the toner supplying container 301 is mounted on the apparatus main body 100, there is no interference of the drive transmitting claw 521 with the transmitting member 306.

In addition, in the toner supplying container that was moved from the state shown in FIG. 7 to the state shown in FIG. 6 due to the above-mentioned means, because the drive transmitting claw 521 is moved by the urging means 524 with the evacuation of the transmitting member 306 counterclockwise, the transmitting claw portion 306*a* of the transmitting member 306 and the claw portion 521*a* of the drive transmitting claw 521 continue to maintain the engaging state.

Therefore, the transmitting member 306 rotates through the one-way gear 527, the driving shaft 522 and the drive transmitting claw 521 due to the drive means of the main body not shown, and the agitating member 305 also rotates.

Now, the discharge of toner will be described.

When the toner supplying container 301 is mounted on the apparatus main body 100, the engaging protrusion 303*e* which serves as the engaging portion of the sealing member 303 leading end (refer to FIG. 10A) is engaged with the engaging member 6 of the image forming apparatus body 100 as shown in FIG. 6, and the sealing member 303 is held at a position apart from the toner supply port 301*g* of the container main body 301A. In this situation, the engaging relation in the rotating direction between the transmitting member 302 and the sealing member 303 is held as it is.

Also, the sealing member 303 is engaged with the first coupling member 304 of the apparatus main body 100 by the coupling engaging portion (drive force receiving portion) 303*c* having the protrusion 303*d*. The first coupling member 304 receives the rotating drive through a drive transmitting means (not shown) such as a gear from a drive source (not shown) such as a motor of the apparatus main body 100, and then transmits the rotating drive to the feeding member 302 and engages the drive transmitting portion 513*a* shown in FIG. 16 with the spline-shaped protrusion 303*d* shown in FIGS. 10A to 10D. In addition, the first coupling member 304 transmits the rotating drive to the feeding member 302 and engages the engaging hole 303*a* with one end portion 302*a* of the feeding member 302. Similarly, the transmitting member 306 that is engaged with one end 305*d* of the agitating member 305 is engaged with the second coupling member 307 of the apparatus main body 100. The second coupling member 307 of the apparatus main body 100 receives the rotating drive from a drive source (not shown) such as a motor through a drive transmitting means (not shown) such as a gear, and the claw portion 512*a* of the second coupling member 307 is engaged with the transmitting claw portion 306*a* of the transmitting member 306 to transmit the rotating drive to the agitating member 305. The rotating speeds of the feeding member 302 and the agitating member 305 are set to be about 52 r.p.m. and about 10 r.p.m., respectively.

Upon rotation of the agitating member 305, the toner, from which air has escaped and which has agglomerated due to the vibrations during transportation and long term storage, is loosened and then fed toward the toner supply opening portion 301 a due to the rotation of the feeding member 302. The toner is discharged, drops from the toner supply port 301 g, and then is supplied to the toner hopper 201 a of the apparatus main body 100 (the toner may be supplied directly to the developing device depending on the structure of the image forming apparatus).

The toner discharge experiment has been conducted using the container thus structured. The container main body 301A is filled with the toner, and the rotating speed of the agitating member 305 is set to be about 10 r.p.m. and the rotating speed of the transporting member is set to be about 52 r.p.m. to discharge the toner. Then, because a comb (teeth spacing of 75 $\mu$m made by SUS) recognizes the amount of coarse particles formed as the toner is discharged from the container main body 301A, there are no coarse particles. Likewise, only 20 g of toner remains within the main body 301A, and the amount of remaining toner has been reduced.

Figure 22:
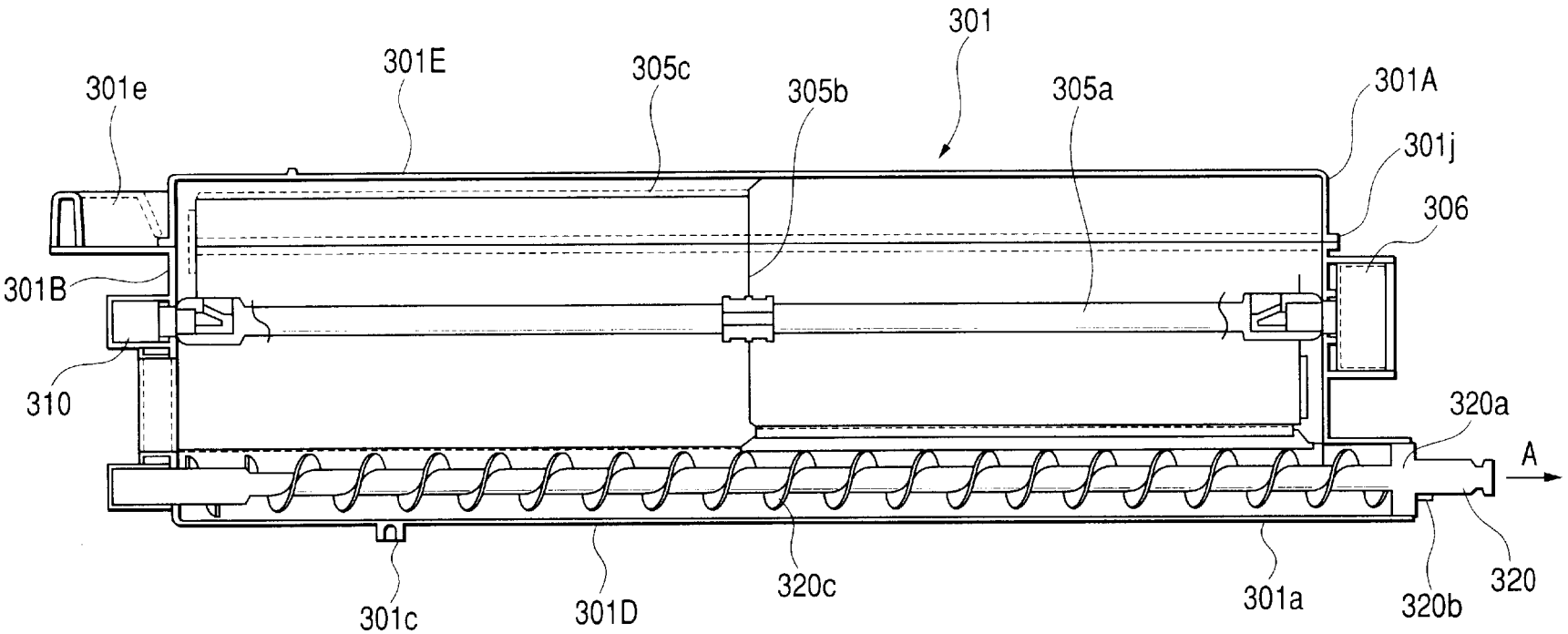
FIG. 22 is a vertical cross-sectional view showing an example in which the sealing member and the transporting member are integrated together.

In this embodiment, the sealing member 303 is so structured as to be movable in the axial direction with respect to the feeding member 302, but the sealing member and the transporting member may be integrated with each other as shown in FIG. 22. Referring to FIG. 22, the sealing member 320 includes the sealing portion 320*a*, the drive force receiving portion 320*b* and the toner feeding portion 320*c*. Then, the sealing member 320 is so designed as to be movable in a direction indicated by an arrow A in FIG. 22 with respect to the container main body 301A.

Figure 23A:
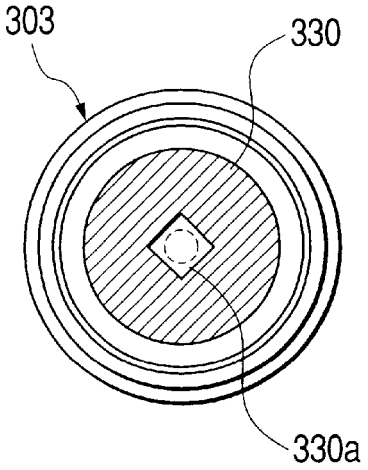
FIG. 23A is a front view showing the sealing member having a packing member.
Figure 23B:
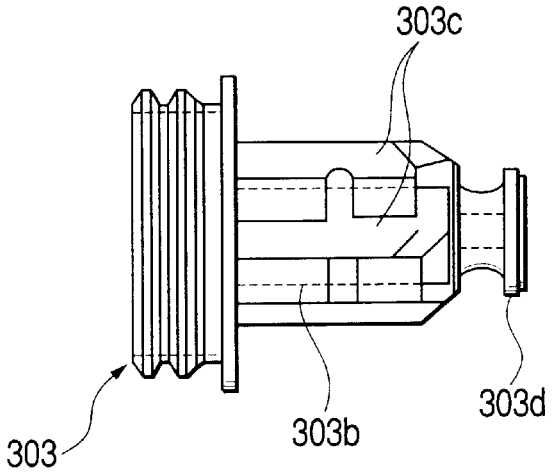
FIG. 23B is a side view thereof.
Figure 23C:
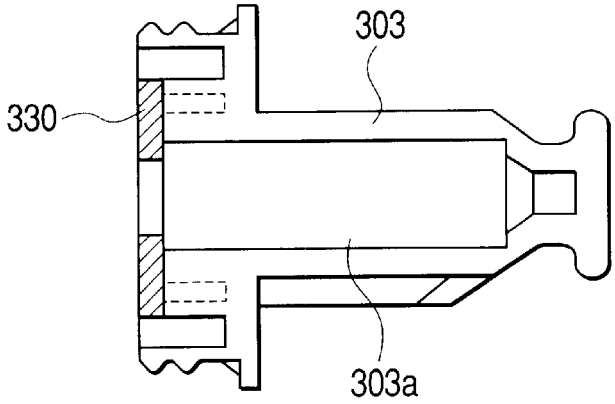
FIG. 23C is a side cross-sectional view thereof.

Also, a packing member may be provided in the engaging hole 303*a* of the drive portion (drive force transmitting portion) having the sealing member 303. FIG. 23A is a front view showing the sealing member having a packing member, FIG. 23B is a side view 10 thereof, and FIG. 23C is a side cross-sectional view thereof.

Figure 24A:
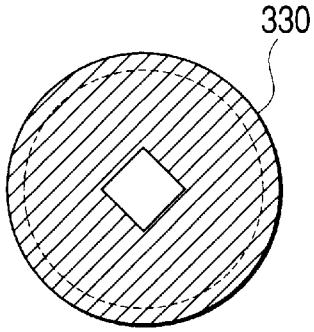
FIG. 24A is a front view showing the packing member at the container main body side.
Figure 24B:
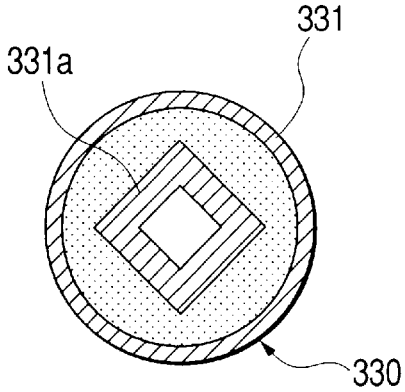
FIG. 24B is a front view showing the packing member at the sealing member side.

Reference numeral 330 denotes a disc-shaped packing member having a rectangular hole 330*a* corresponding to the shape of one end portion 302*a* of the shaft of the agitating member 302. In this embodiment, the cross-sectional shape of the hole 330*a* is square, as is the axial end portion 302*a*. The packing member 330 is disposed at a side of the sealing member 303 opposite to the container main body 301A, and the one end portion 302*a* (refer to FIG. 7) of the shaft of the feeding member 302 penetrates the hole 330*a* so as to be loosely fitted into the hole 303*a*. FIGS. 24A and 24B are front views showing the packing member 330 to which the embodiment of the present invention is applied. Reference numeral 331 denotes an adhesive double-coated tape which is disposed at a side of the packing member 330 opposite to the sealing member 303. The adhesive double-coated tape 331 has a hole 331*a* and is so structured as to coincide with the hole 330*a* when the axial end portion 302*a* is loosely fitted into the hole 303*a*. Also, the cross-sectional shape of the hole 331 a is set to be larger than the hole 330*a* so that the adhesive double-coated tape 331 is out of the axial end portion 302*a*. In this embodiment, the sealing member 303 and the packing member 330 are fixed by the adhesive double-coated tape, but as another fixing method, the sealing member 303 and packing member 330 may be integrated by two-color molding or insertion molding.

Figure 25:
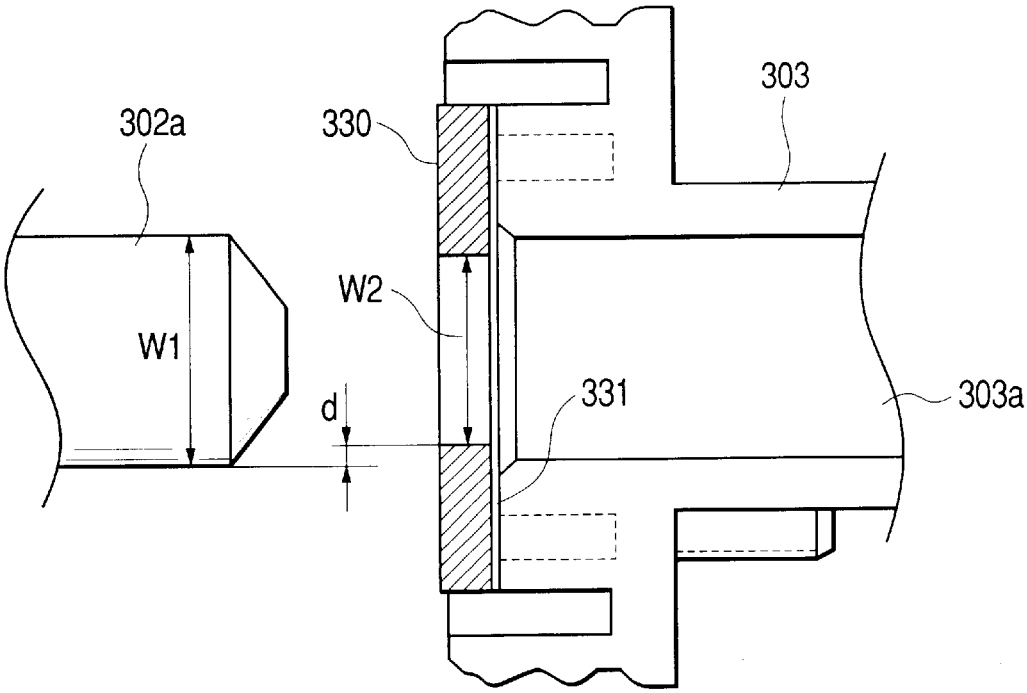
FIG. 25 is an enlarged side view showing the transportation member and the sealing member.

FIG. 25 is an enlarged side view showing the feeding member 302 and the sealing member 303 to which the embodiment of the present invention is applied. The diameter (W2) of the hole 330*a* is set to be smaller than the shaft diameter (W1=6 mm) of the axial end portion 302*a*, and specifically, it is preferable that a difference (d) between W1 and W2 is set to be 0.5 mm to 2 mm. In this embodiment, W2=5 mm, d=W1−W2=1 mm. It is preferable that the thickness of the packing member 330 is set to be 0.5 mm to 5 mm taking the sealing property and the assembling property into consideration. It is more preferable that the thickness of the packing member 330 is set to be 1 mm to 3 mm. In this embodiment, the thickness of the packing member 330 is set to be about 2 mm. The material of the packing member 330 is preferably made of a soft elastic member taking the sealing property and the assembling property into consideration, and in this embodiment, the material of the packing member 330 is made of a low-foaming polyurethane of 20° to 70° in hardness, 4% or less in compression permanent distortion, $\mu$=0.8 or less in frictional coefficient, 60 to 300 $\mu$m in cell size and 0.2 to 0.5 in specific weight.

The toner supplying container 1 thus structured is filled with the toner, the rotating speed of the agitating member 305 is set to 25 r.p.m., and the toner is discharged. Thereafter, the sealing member 303 is continuously opened and closed. As a result, even after performing the open/close operation more than 200 times, the toner will not enter the depth of the hole 303*a* and the seal can be formed.

Also, as the material member of the packing member, rubber such as a silicon, urethane, and thermoplastic elastomer and sponge, such as polystyrene, polyolefins, polyurethanes, polyesters, and polyamide may be used. Experiments have been conducted using a container main body that contains a packing member fixed to a sealing member. These experiments yielded the same results as when a foaming member, polyurethane found in the packing member, was used.

Figure 26:
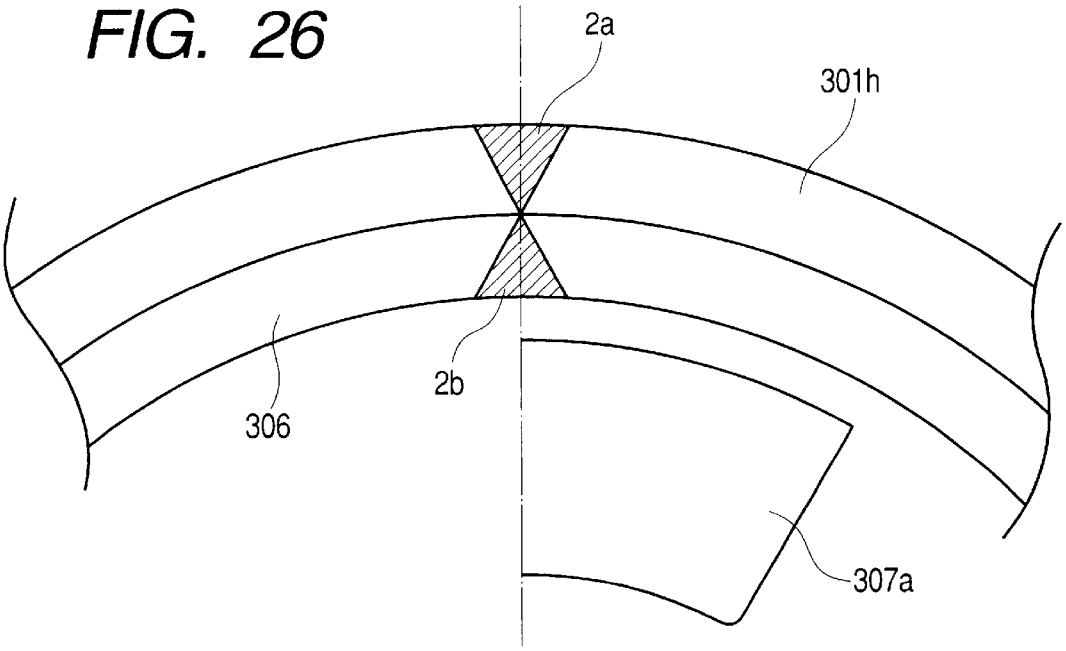
FIG. 26 is a partially enlarged view showing a right side surface of the toner supplying container in accordance with a first embodiment of the present invention.

FIG. 26 shows an enlarged right side view showing the toner supplying container to which the embodiment of the present invention is applied and shows a right end side of the agitating member 305 in the axial direction. Referring to FIG. 26, a cylindrical bearing portion 301*h* (refer to FIG. 9A) projecting from the side wall (end wall) at the right surface side of the container main body 301A is provided with a positioning mark 2*a*. Also, in the bearing portion 301*h*, the transmitting member 306 engaged with one end of the agitating member 305 (not shown)(refer to FIGS. 7 and 21A to 21D) is provided with a positioning mark 2*b*. The positioning mark may be replaced by a member disposed on the surface of the transmitting member 307 such as the transmitting claw portion 307*a*.

Figure 27A:
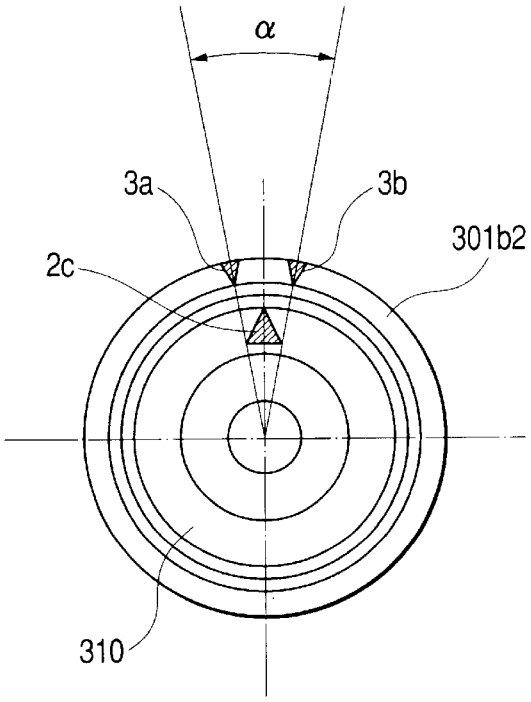
FIGS. 27A and 27B are partially enlarged views showing the left side surface of the toner supplying container in accordance with the first embodiment of the present invention.
Figure 27B:
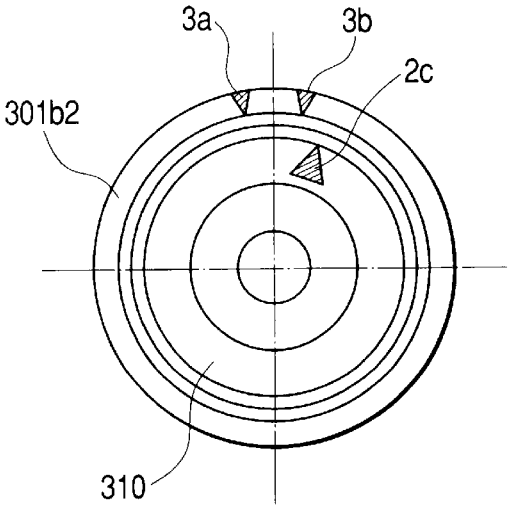

FIGS. 27A and 27B shows a left side enlarged view of the toner supplying container to which the embodiment of the present invention is applied and shows the left end side of the agitating member 305 in the axial direction. Referring to FIGS. 27A and 27B, the cylindrical second receiving portion 301*b*2 projecting from the side wall (end wall) of the left surface side of the container main body is provided with range marks 3*a* and 3*b*. Also, in the second receiving portion 301*b*2, the stopper member (second bearing member) 310 which is engaged with the other end of the agitating member 305 (not shown) is provided with a positioning mark 2*c*. The agitating member 305 is so structured as to be assembled only in a state where the transmitting member 306 and the stopper member 310 have a certain directional engaging angle, so that reverse assembling cannot be made. With this structure, the positioning mark can be effectively used to determine as to whether or not the agitating member has an abnormality.

In the structure for achieving the above, since the transmitting member 306 and the stopper member 301 are identical in structure with each other, only the transmitting member 306 will be described.

As shown in FIGS. 21A to 21D, the transmitting member 306 is disposed with a shaft portion 306*b*, which is hexagonal in section in the center axial direction. The leading edge of the shaft portion 306*b* is provided with a check claw 306*c*. The check claw 306*c* is integrally molded with the shaft portion 306*b* at the outer peripheral side of the end side of the shaft portion 306*b*, and a stem 306*c*1 extends in the axial direction and a claw portion 306*c*2 is bent at about 180 degrees at the leading edge. The claw portion 306*c*2 is flexible and enables the leading edge side to approach the stem 306*c*1.

On the other hand, one end 305*d* of the shaft portion 305*a* of the agitating member 305 is provided with a rectangular hole 305*d*1 into which the claw portion 306*c*2 can be inserted only in a state where the claw portion 306*c*2 approaches the stem 306cl. The claw portion 306*c*2 that has passed through the 5 rectangular hole 305*d*1 is restored, and the leading edge is moved out of the rectangular hole 305*d*1, and the transmitting member 306 is fixed to the shaft portion 305*a* of the agitating member 305.

In the above structure, since the rectangular hole 305*d*1 is sided to the outer side of the axial center in the radial direction, the check claw 306*c* enters the rectangular hole 305*d*1 only in the state shown in FIGS. 21A to 21D but does not enter the rectangular hole 305*d*1 at a position rotated by 180 degrees and at other positions.

Figure 28:
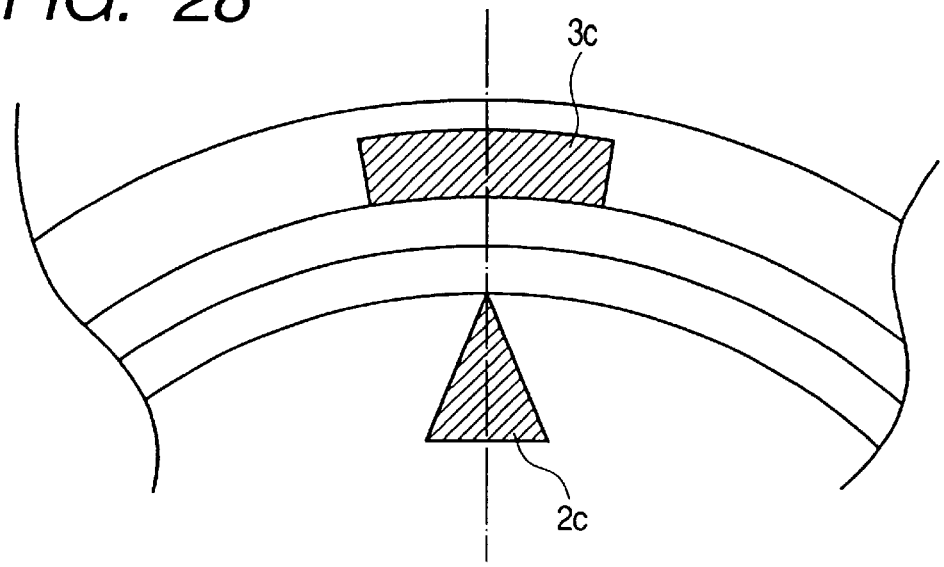
FIG. 28 is a partially enlarged view showing the left side surface of a toner supplying container in accordance with the first embodiment of the present invention.

The positioning mark 2*c* is so set as to be positioned within the angular range between the range marks 3*a* and 3*b* as shown in FIG. 27A when the rotating angle position of the positioning mark 2*a* coincides with the positioning mark 2*b*. In this example, the range marks 3*a* and 3*b* may be one mark indicative of a given angular range as in the mark 3*c* shown in FIG. 28. It is preferable that an allowable angle range α between the range marks 3*a* and 3*b* are set to be about 10 to 30°. More preferably, the allowable angle range is set to be about 20°. In this embodiment, the allowable angle range a is set to be 20°.

Assuming that the toner supplying container thus structured is used and the toner is solidified within the container during circulating transportation, after tapping has been made in a position where the toner supplying container 1 filled with the toner is mounted on the apparatus main body 100, the agitating member 305 is rotated, and a starting torque at that time was measured. Tapping was conducted under the conditions where the toner supplying container 1 is fixed to the tapping table and is then allowed to drop 1000 times continuously at the height of 10 mm and with the vibrating frequency of 2 Hz. As a result, the rotating initial torque of the agitating member 305 became about 30 kgf·cm. Thereafter, all of the toner within the container main body 301A is discharged, the toner supplying container 1 is disassembled, and the contents were recognized. As a result, no abnormality such as the deformation of the agitating member 305 was found. In addition, when the rotating angle position of the positioning mark 2*a* coincided with the positioning mark 2*b*, the positioning mark 2*c* was positioned within the angle range between the mark 2*c* was positioned within the angle range between the range marks 3*a*and 3*b* as shown in FIG. 27A. When the toner supplying container 1 was once again filled with the toner and the toner was once again discharged, the amount of remaining toner within the container main body 301A after the discharge has been completed was 30 g. Also, there were no coarse particles found in the discharged toner.

Next, assume that the toner is excessively solidified within the container main body 301A. After tapping has been made 2000 times in a position where the container main body 301A filled with the toner was mounted on the apparatus main body 100, the agitating member 305 was rotated and the start torque at that time was measured. The rotating initial torque of the agitating member 305 was about 45 kgf·cm. Thereafter, all of the toner within the container main body 301A was discharged, the container main body 301A was disassembled, and the contents were recognized. As a result, the agitating member 305 was deformed in the circumferential direction of the axis. Further, when the rotating angle position of the positioning mark 2*a* at one end side of the agitating member 305 in the axial direction coincided with the positioning mark 2*b*, the positioning mark 2*c* of the agitating member 305 at the other end side in the axial direction was out of the angle range between the range marks 3*a* and 3*b* shown in FIG. 27B. The container main body 301A was again filled with the toner, and the toner was discharged. As a result, the amount of remaining toner within the container main body 301A after the discharge has been completed was 60 g, which was a remarkable increase compared with a case where the agitating member 305 of the toner supplying container was not deformed. Also, a slight amount of coarse particles in the discharged toner was recognized.

Also, when the toner supplying container 1 where the toner has been supplied actually is collected and the rotating angle position of the positioning mark 2*a* has coincided with the positioning mark 2*b*, the container main body 301A where the positioning mark 2*c* has been positioned within the angle range between the range marks 3*a* and 3*b* was again filled with the toner, and the toner was discharged. As a result, the amount of toner within the container main body 301A after the discharge has been completed was the same level as that in an unused product. Also, no coarse particles were found in the discharged toner.

As described above, after the rotating angle position of one end side of the agitating member had coincided with a predetermined position of the container main body, the positional recognition of the other end side of the agitating member and the container main body was conducted according to the range mark indicative of the positioning mark and the predetermined angle range. Thus, it is possible to determine an abnormality such as the deformation of the agitating member within the container, even if the container is not disassembled. As a result, the determination of the possibility of the recycle of the container can be readily conducted.

In the above-described embodiment, the structure in which the coupling member and the stopper member are engaged with both of the end sides of the rotary member are engaged with both of the end sides of the rotary shaft of the agitating member, as well as the structure in which the rotary shaft is pivotally supported to the container main body through those members was described. However, the present invention is not limited to the above-described structure and the structure shown in FIG. 30 may be applied.

Figure 30:
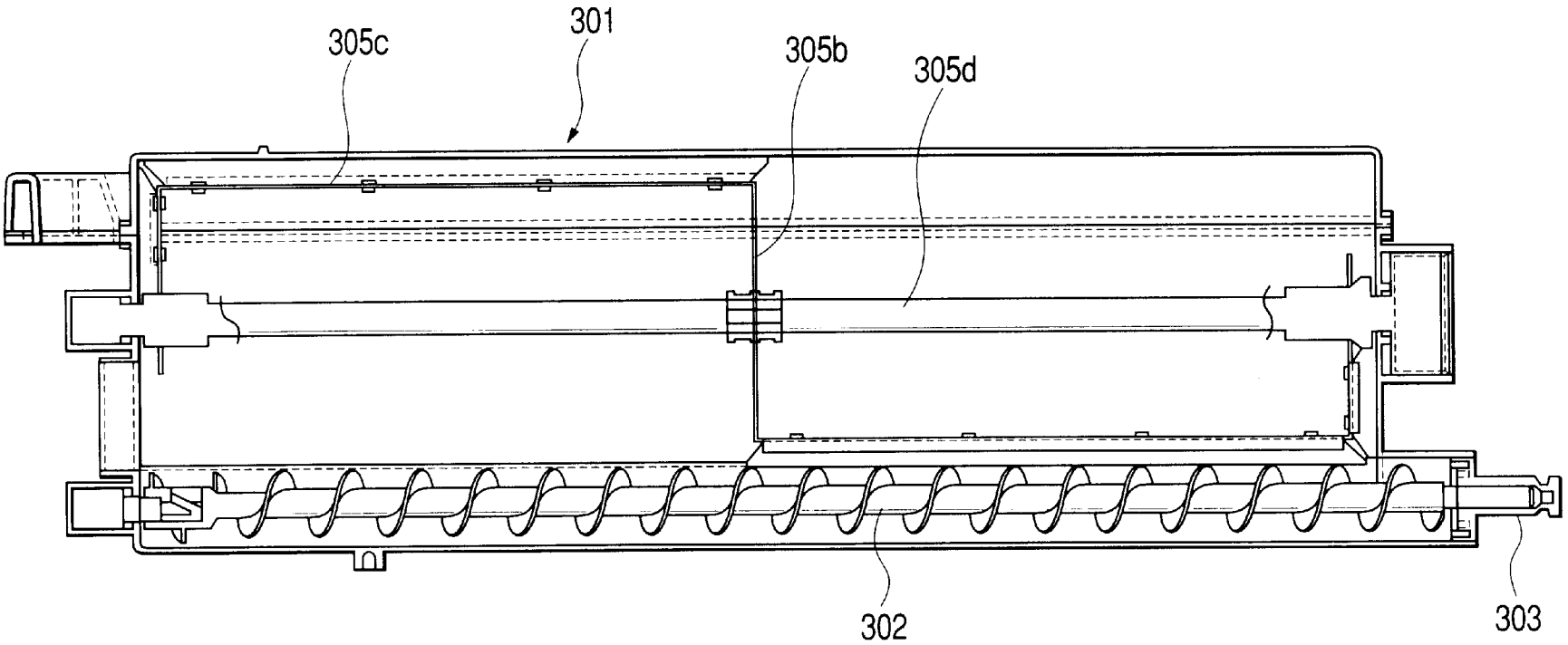
FIG. 30 is a vertical cross-sectional view showing a toner supplying container in accordance with another applied example of the present invention.

That is, in FIG. 30, the rotary shaft per se of the agitating member is integrally molded so as to serve as the coupling member and the stopper member. Even in the structure shown in FIG. 30, the same actions and effects can be obtained if the present invention is applied to such a structure. The above structure can be applied to the following embodiment.

Second Embodiment

Figure 29:
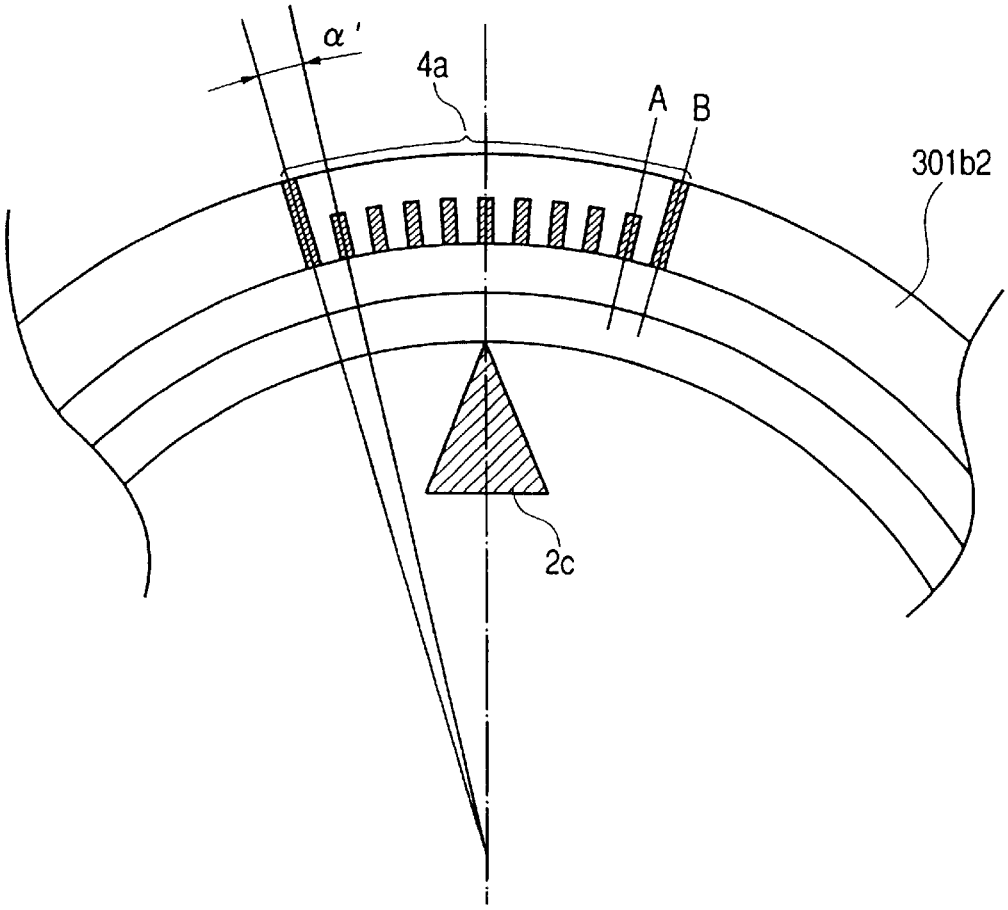
FIG. 29 is a partially enlarged view showing the left side surface of a toner supplying container in accordance with a second embodiment of the present invention.

FIG. 29 shows a partially enlarged view of the left side surface of the toner supplying container to which a second embodiment of the present invention is applied. Referring to FIG. 29, graduations 4*a* are disposed at given angle intervals in a cylindrical second receiving portion 301*b*2 projecting from the side wall of the container main body 301A at the left side. It is preferable that the angle range α at one interval of the graduations 4*a* is set to be about 1 to 5°. In this embodiment, the angle range α is set to be 3°. The other structures are identical with those in the first embodiment.

Assuming that the toner supplying container thus structured is used and the toner is excessively solidified within the container main body 301A rather than the normal toner, after tapping has been made 1500 times and 2000 times in a position where the toner supplying container 1 filled with the toner was mounted on the apparatus main body 100, the agitating member 305 was rotated and the start torque. at that time was measured. The tapping conditions are identical with those in the first embodiment. As a result, the rotating initial torque of the agitating member 305 was about 40 kgf·cm at the time of tapping 1500 times and about 45 kgf·cm at the time of tapping 200 times. Thereafter, all of the toner within the container main body 301A was discharged, the container main body 301A was discharged, the container main body 301A was disassembled. and the contents were recognized. As a result, the agitating member 305 was deformed in the circumferential direction of the axis under both of those two conditions, but the degree of deformation at the time of tapping 2000 times was slightly larger. Further, when the rotating angle position of the positioning mark 2*a* coincided with the positioning mark 2*b*, the positioning mark 2*c* was at a position A in the graduations 4*a* after 1500 taps, and was at a position B after 2000 taps. The toner supplying container 1 was again filled with the toner, and the toner was discharged. As a result, the amount of remaining toner within the container main body 301A after the discharge was completed was 50g after 1500 taps and 60g after 2000 taps. Thus, more toner remains after 2000 taps when the degree of deformation of the agitating member 305 is large. Also, a slight amount of coarse particles in the discharged toner was recognized under both of the conditions.

As described above, the rotating angle position of the bearing member that is engaged with one end of the agitating member is allowed to coincide with a predetermined position of the container main body, and the positional recognition of the bearing member that is engaged with the other end and the container main body is conducted by the graduations where the positioning mark and the predetermined angle intervals are provided, thereby being capable of determining a difference in the degree of deformation of the agitating member even if the toner supplying container is not disassembled. The above values of the graduations are regarded as the degree of deterioration of the agitating member so that the deterioration circumstance of the respective toner supplying container which has been used can-be managed.

Third Embodiment (Method of Remanufacturing Toner Supplying Container)

A method of remanufacturing the toner supplying container from which the toner has been completely consumed.

(a) A toner supplying container includes a toner filling port 301*i* that serves as an opening portion for filling the toner; a toner supply opening portion 301*a* that serves as an opening portion for discharging the toner; sealing members 311 and 303 for sealing the above two opening portions 301*i* and 301*a*, respectively; and a toner agitating member 305 for agitating the toner contained in the container, in which a transmitting member 306 that serves as a rotating portion which rotates integrally with the rotating portion at both ends of the agitating member 305 or the agitating member 305, and a second bearing member 310 are exposed from the container main body 301A that constitutes the toner containing portion, and inspection marks (refer to the first or second embodiment) are disposed at the rotating portion and at both end sides of the container main body 301A corresponding to the rotating portion.

In this example, the rotating portions of the agitating member 305 at both ends thereof are supported to the holes at both end walls of the container main body 301A in the axial direction (not shown).

Also, both end sides of the container main body 301A corresponding to the above-described exposed portion are directed to a fixed portion which is at substantially the same position as that of the rotating member in the axial direction of the agitating member 305 as described as the second receiving portion 301*b*2 disposed on the end wall of the container main body 301A, the bearing portion 301*h*, and so on in the first and second embodiments.

In summary, the toner supplying container from which the toner has been consumed as described in the first and second embodiments is prepared.

(b) A first process is as follows:

The sealing member 311 that tightly seals the toner filling port 301*i* which is an opening portion for filling the toner and the sealing member 303 that tightly seals the toner supply opening portion 301*a* which is an opening portion that discharges the toner are taken out from the toner supplying container, respectively. Since those sealing members 303 and 311 are force-fitted into the opening portions 301*a* and 301*i*, respectively, they are drawn by using a tool such as a plier or automatically taken out.

(c) Clean the toner supplying container in a second process.

This cleaning, for example, blows compressed air through the toner filling port 301*i* and sucks the air from the toner supply opening portion 301*a*. In this situation, the blowing of the compressed air and the suction of the air are conducted while the agitating member 305 rotates by using a device (not shown) for rotating the agitating member 305. As a result, the residual toner in the toner supplying container 1 is removed. During the above-described cleaning, when a shock is given to the container main body 301A by a hammer or the like, or vibrations are given to the container main body 301A, the toner stuck onto the inner wall of the container main body 301A can be effectively removed.

(d) The abnormality of the agitating member 305 is recognized in a third process. As was already mentioned above, on one end side of the container main body 301A, after the positioning marks 2*a* and 2*b* of the second coupling member 306 are allowed to coincide with each other, it is checked whether the positioning mark 2*c* of the second bearing member (stopper member) 3exists within the range graduations 3*a* and 3*b* at the other end side of the container main body 301A, or not. If it is within the range graduations 3*a* and 3*b*, the following process is continued. If it is out of the range graduations 3*a* and 3*b*, the damages of the agitating member 305 and the peripheral portion thereof are presumed, and remanufacture is made by resource restoration or another remanufacturing method (its description will be omitted).

In this example, when the positioning mark 2*c* is out of the range marks 3*a* and 3*b*, the damage of the following portions is presumed.

(1) The deformation of the coupling portion of the transmitting member 306 with the shaft portion 305*a* of the agitating member 305

(2) The twist of the agitating shaft 305*a*

(3) The deformation of the coupling portion of the shaft portion 305*a* of the agitating member 305 with the second bearing member 310. In case of the above (1) and (2), the damage is caused by a case in which the agitating load exerted on the agitating member 305 is large, or a case in which the torque load becomes excessive due to an increase in the frictional force between the second bearing member 3*a*and the second receiving portion 301*b*2.

In case of the above (3), the damage is caused by an increase in the torque load due to an increase in frictional force between the second bearing member 310 and the second receiving portion 301*b*2.

The examination of the agitating member 305 is made according to the first embodiment, but may be made according to the second embodiment which was already mentioned.

(e) The toner supply opening portion 301*a* is sealed with the sealing member 303 in a fourth process. The sealing is executed by catching the sealing member 303 by a plier or the like and force-fitting the sealing member 303 into the toner supply opening portion 301*a*.

(f) The toner is filled in the toner supplying container 1 from the toner filling port 301*i* in a fifth process. The toner filling is conducted by using a constant-quantity supply device.

(g) The sealing member 311 is fitted onto the toner filling port 301*i* in a sixth process. The fitting of the sealing member 311 is conducted by lightly force-fitting the sealing member 311 into the toner filling port 301*i*. That is, the sealing member 311 is force-fitted into the toner filling port 3011 by using a press machine.

In this embodiment, the abnormality of the agitating member 305 is recognized, but the present invention is not limited to this structure. It is preferable that the process of recognizing the abnormality of the agitating member is conducted after the cleaning process in which the toner within the container main body is removed. This is because there is a case where a large amount of toner remains in the toner supplying container which has been collected for remanufacture, and a case where a large amount of toner does not remain therein. In other words, if the recognizing process is conducted prior to the cleaning process, there is a fear that the agitating member will be determined abnormal due to the remaining toner, even if no abnormality occurs in the agitating member. Therefore, if the recognizing process is conducted after the cleaning process, since the conditions of the toner supplying container in the recognizing process can be made to coincide with each other, the abnormality can be recognized and determined excellently.

With the above operation, the toner supplying container is remanufactured.

In this way, when the toner supplying container is remanufactured, the damage on the agitating member or its support portion can be determined without disassembling the container main body.

With the use of the above-mentioned remanufacturing method, the abnormality such as the deformation of the agitating member packed in the container main body can be visually recognized from the external, and it can be readily determined whether the toner supplying container can be remanufactured, or not.

In the above-described embodiments, the toner supplying container supplies the toner to the image forming apparatus. However, the present invention is not limited to this structure, for example, if the image forming apparatus is so structured as to form an image by using a developer having toner and carrier, the toner supplying container may be structured to receive the toner and the carrier which are supplied to the image forming apparatus.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A toner container detachably mountable on an image forming apparatus, said toner container comprising:

a container body for containing toner therein;

an agitating member, disposed within said container body, for agitating the toner within said container body; and first and second rotating portions that rotate together with a rotary shaft of said agitating member at both end sides of said rotary shaft, said first and second rotating portions being exposed to an exterior of said container body, wherein said container body includes a first mark at a position corresponding to a predetermined position of said first rotating portion and a second mark at a position corresponding to a predetermined position of said second rotating portion.

2. A toner container according to claim 1, wherein said first and second rotating portions are engaged with said rotary shaft, respectively, and said first and second rotating portions are rotatably supported by said container body.

3. A toner container according to claim 2, wherein said rotary shaft includes restricting portions that restrict an engaging angle of said first and second rotating portions with respect to said rotary shaft at both end sides thereof, respectively.

4. A toner container according to claim 2, wherein a third mark is disposed at the predetermined position of said first rotating portion.

5. A toner container according to claim 4, wherein said first rotating portion includes an engaging portion, which is engaged with the image forming apparatus.

6. A toner container according to claim 5, wherein said engaging portion is said third mark.

7. A toner container according to claim 5, wherein said first rotating portion includes a transmitting portion that transmits a drive force from the image forming apparatus to said rotary shaft in a state where said engaging portion is engaged with the image forming apparatus.

8. A toner container according to claim 4, wherein a fourth mark is disposed at the predetermined position of said second rotating portion.

9. A toner container according to claim 8, wherein one of said second mark and said fourth mark is disposed to indicate a predetermined angle range.

10. A toner container according to claim 9, wherein said fourth mark is disposed to indicate the predetermined angle range.

11. A toner container according to claim 10, wherein graduations are provided within the predetermined angle range.

12. A toner container according to claim 2, wherein said first rotating portion and said second rotating portion are portions of said rotary shaft, and said rotary shaft is rotatably supported by said container body through said first and second rotating portions.

13. A toner container according to claim 1, wherein said container body contains the toner, which is supplied to the image forming apparatus in a state where said toner container is mounted on the image forming apparatus.

14. A toner container according to claim 1, wherein said agitating member rotates so as to be in contact with an inner wall of said container body.

15. A toner container according to claim 1, wherein before said toner container is used, when said first rotating portion rotates so that the predetermined position of said first rotating portion faces the first mark, and the predetermined position of said second rotating portion substantially faces the second mark.

16. A toner container according to claim 15, wherein said first rotating portion includes a receiving portion that receives a force that allows said first rotating portion to rotate so that the predetermined position of said first rotating portion faces the first mark.

17. A toner container according to claim 16, wherein said receiving portion is shaped as a protrusion.

18. A toner container according to claim 1, wherein the first and second marks are used to determine an abnormality of said agitating member.

19. A method of determining an abnormality of a toner container detachably mountable on an image forming apparatus, the toner container comprising a container body for containing toner therein; an agitating member disposed within the container body for agitating the toner within the container body; and first and second rotating portions that are exposed to an exterior of the container body and rotate together with a rotary shaft of the agitating member at both end sides of the rotary shaft; wherein the container body includes a first mark at a position corresponding to a predetermined position of the first rotating portion and a second mark at a position corresponding to a predetermined position of the second rotating portion, said method comprising the steps of:

rotating the first rotating portion so that the predetermined position of the first rotating portion faces the first mark; and recognizing whether the predetermined position of the second rotating portion substantially faces the second mark, in order to determine an abnormality of the agitating member in a state where the rotating step has been conducted.

20. A method according to claim 19, wherein said recognizing step is conducted for remanufacturing the toner container is a toner container, which has been used.

21. A method according to claim 20, further comprising a step of cleaning the container body;

wherein said recognizing step is conducted after said cleaning step.

22. A method according to claim 20 or 21, wherein if it is determined that there is no abnormality in the agitating member in said recognizing step, a filling step of filling the container body with the toner is conducted without exchanging the agitating member.

23. A method according to claim 19, wherein before the toner container is used, when the first rotating portion rotates so that the predetermined position of the first rotating portion faces the first mark, the predetermined position of the second rotating portion substantially faces the second mark.

24. A method according to claim 19, wherein the first and second rotating portions are engaged with the rotary shaft, respectively, and the first and second rotating portions are rotatably supported by the container body.

25. A method according to claim 24, wherein the rotary shaft has restricting portions for restricting engaging angles of the first and second rotating portions with respect to the rotary shaft at both end sides of the rotary shaft, respectively.

26. A method according to claim 24, wherein a third mark is disposed at the predetermined position of the first rotating portion.

27. A method according to claim 26, wherein the first rotating portion includes an engaging portion, which is engaged with the image forming apparatus.

28. A method according to claim 27, wherein the engaging portion is the third mark.

29. A method according to claim 27, wherein the first rotating portion includes a transmitting portion that transmits a drive force from the image forming apparatus to the rotary shaft in a state where the engaging portion is engaged with the image forming apparatus.

30. A method according to claim 26, wherein a fourth mark is disposed at the predetermined position of the second rotating portion.

31. A method according to claim 30, wherein one of the second mark and the fourth mark is disposed to indicate a predetermined angle range.

32. A method according to claim 31, wherein the fourth mark is disposed to indicate the predetermined angle range.

33. A method according to claim 32, wherein graduations are provided within the predetermined angle range.

34. A method according to claim 24, wherein the first rotating portion and the second rotating portion are portions of the rotary shaft, and the rotary shaft is rotatably supported by the container body through the first and second rotating portions.

35. A method according to claim 19, wherein the container body contains the toner which is supplied to the image forming apparatus in a state where the toner container is mounted on the image forming apparatus.

36. A method according to claim 19, wherein the agitating member rotates to be in contact with an inner wall of the container body.

* * * * *

UNITED STATES PATENT AND TRADEMARK OFFICE

CERTIFICATE OF CORRECTION

PATENT NO. : 6,493,516 B2
DATED : December 10, 2002
INVENTOR(S) : Katsuya Murakami et al.

It is certified that error appears in the above-identified patent and that said Letters Patent is hereby corrected as shown below:

Column 2,
Lines 18 through 21, should be deleted.

Column 4,
Line 36, “101” should read -- 101. --.

Column 5,
Line 31, “201*f*;” should read -- 201*f* --.

Column 6,
Line 30, “301gshown” should read -- 301g shown --.

Column 8,
Line 17, “semi-circular.” should read -- semicircular --.

Column 9,
Lines 17 and 28, “301a” should read -- 301a1 --; and
Line 24, “301aI” should read -- 301a1 --.

Column 10,
Line 4, “interval. specifically,” should read -- interval. ¶Specifically, --.

Column 11,
Line 26, “303dof” should read -- 303d of --; and
Line 31, “303 as” should read -- 303 has --.

Column 12,
Line 39, “305b 1” should read -- 305b1 --.

Column 13,
Line 7, “abovementioned” should read -- above-mentioned --.

Column 14,
Line 50, “301 i” should read -- 301i --.

UNITED STATES PATENT AND TRADEMARK OFFICE

CERTIFICATE OF CORRECTION

PATENT NO. : 6,493,516 B2
DATED : December 10, 2002
INVENTOR(S) : Katsuya Murakami et al.

It is certified that error appears in the above-identified patent and that said Letters Patent is hereby corrected as shown below:

Column 15,
Line 1, “FIG. Is” should read -- FIG. 15 is --.

Column 16,
Line 20, “301 g” should read -- 301g --.

Column 17,
Line 29, “521 c,” should read -- 521c, --.

Column 18,
Line 51, “301 a” should read -- 301a --; and
Line 53, “301 g,” should read -- 301g, --; and “201 a” should read -- 201a --.

Column 19,
Line 35, “331 a” should read -- 331a --.

Column 20,
Line 64, “the 5” should read -- the --.

Column 21,
Line 16, “range a” should read -- range α --;
Line 37, “mark 2c was positioned” should be deleted; and
Line 38, “within the angle range between the” should be deleted; and “3aand” should read -- 3a and --.

Column 22,
Lines 50 and 52, “range α” should read -- range α' --; and
Line 60, “torque.” should read -- torque --.

Column 23,
Line 30, “can-be” should read -- can be --.

UNITED STATES PATENT AND TRADEMARK OFFICE

CERTIFICATE OF CORRECTION

PATENT NO. : 6,493,516 B2
DATED : December 10, 2002
INVENTOR(S) : Katsuya Murakami et al.

It is certified that error appears in the above-identified patent and that said Letters Patent is hereby corrected as shown below:

Column 24,
Line 31, "3exists" should read -- 310 exists --; and
Line 54, "3aand" should read -- 310 and --.

Column 25,
Line 9, "3011" should read -- 301i --.

Column 27,
Lines 29 and 30, "the toner container is a toner container, which has been used." should read -- a toner container, which has been used. --.

Signed and Sealed this

Twenty-sixth Day of August, 2003

JAMES E. ROGAN
*Director of the United States Patent and Trademark Office*